US009556565B2

(12) United States Patent
Langenbeck

(10) Patent No.: US 9,556,565 B2
(45) Date of Patent: Jan. 31, 2017

(54) TRAIN RAIL TRACK STRUCTURE SYSTEMS

(71) Applicant: Keith A. Langenbeck, Pleasant View, TX (US)

(72) Inventor: Keith A. Langenbeck, Pleasant View, TX (US)

( * ) Notice: Subject to any disclaimer, the term of this patent is extended or adjusted under 35 U.S.C. 154(b) by 277 days.

(21) Appl. No.: 14/252,952

(22) Filed: Apr. 15, 2014

(65) Prior Publication Data

US 2014/0312133 A1 Oct. 23, 2014

Related U.S. Application Data

(60) Provisional application No. 61/811,823, filed on Apr. 15, 2013.

(51) Int. Cl.

| | |
|---|---|
| ***E01B 3/00*** | (2006.01) |
| ***E01B 3/16*** | (2006.01) |
| ***E01B 3/22*** | (2006.01) |
| ***E01B 29/06*** | (2006.01) |

(52) U.S. Cl.
CPC . *E01B 3/16* (2013.01); *E01B 3/22* (2013.01); *E01B 29/06* (2013.01); *E01B 2204/03* (2013.01); *Y10T 29/49826* (2015.01)

(58) Field of Classification Search
CPC ..... E01B 3/20; E01B 3/22; E01B 3/16; E01B 3/48
See application file for complete search history.

(56) References Cited

U.S. PATENT DOCUMENTS

| | | | | | |
|---|---|---|---|---|---|
| 1,431,094 | A * | 10/1922 | Bodkin | E01B 3/48 | 238/105 |
| 1,626,317 | A * | 4/1927 | Webster | E01B 3/48 | 238/105 |
| 1,632,466 | A * | 6/1927 | Feagans | E01B 3/48 | 238/168 |
| 1,761,147 | A * | 6/1930 | Muller | E01B 3/22 | 238/27 |
| 2,669,394 | A * | 2/1954 | Poebing | E01B 3/22 | 238/169 |
| 3,687,366 | A * | 8/1972 | Paterson | E01B 1/007 | 238/105 |
| 5,104,039 | A * | 4/1992 | Oestmann | E01B 3/00 | 238/106 |
| 5,507,434 | A * | 4/1996 | Chambers | E01B 26/00 | 238/105 |

(Continued)

*Primary Examiner* — Jason C Smith
(74) *Attorney, Agent, or Firm* — Lyman Moulton Esq.

(57) ABSTRACT

A train rail track structure system includes a c-face down steel channel cross tie defining a plurality of holes in a top wider web surface thereof and a protrusion with perpendicular faces extending from an underside of the top surface, the holes configured to pass a fixative and solidifying mixture into a ballast bed there beneath. The protrusion anchors the steel channel cross tie in the fixative and solidifying mixture and the ballast bed. The disclosed system also includes a c-face down steel channel connecting link defining a receptacle for at least one intermediate rail support member in a top wider web surface thereof. The link also defines tabs and notches proximal to both longitudinal ends of the steel channel connecting link configured to interleave with at least one steel channel cross tie and interlock the steel channel connecting link to the steel channel cross tie.

14 Claims, 19 Drawing Sheets

(56) References Cited

U.S. PATENT DOCUMENTS

| | | | | |
|---|---|---|---|---|
| 2007/0267511 | A1* | 11/2007 | Foan | E01B 3/20 238/29 |
| 2011/0155819 | A1* | 6/2011 | Ryu | E01B 1/007 238/54 |
| 2014/0312133 | A1* | 10/2014 | Langenbeck | E01B 3/16 238/30 |

* cited by examiner

TRAIN RAIL TRACK STRUCTURE SYSTEMS

CROSS-REFERENCE TO RELATED APPLICATION

This application claims the benefit of the priority date of earlier filed U.S. Provisional Patent Application Ser. No. 61/811,823 titled 'Train Rail Track Structure Systems' filed Apr. 15, 2013 by Keith A. Langenbeck, and is incorporated herein by reference in its entirety.

BACKGROUND OF THE INVENTION

Conventional train rail track structures are typically comprised of approximately 6 or more major components: (1) the steel rail, (2) the tie plate or "chair" that the rail sits on, (3) the railroad cross tie or "sleeper" to which two tie plates are affixed, (4) the fasteners that secure the rail to the tie plate and tie plate to the cross tie, (5) a means for adjoining consecutive lengths of rail sections and (6) the foundation or bed of ballast rock in which the cross ties are located and the track system is held in place.

In North America wood is the predominant cross tie material used in track structures. It is first treated with a preservative such as creosote, then field assembled with the rail via a metal tie plate and screw or spike fasteners through the tie plate into the wood. The list of problems with wood cross ties include splitting or cracking along the grain lines, spikes coming loose or working out from the tie plates, insect degradation, weather degradation, leaching of toxic chemicals into the ground water, air pollution when incinerated, loose tie plates that can result in rail gauge changes, shifting in the ballast bed under side loads, not being strong or stiff enough for high speed use and floating or being washed away when submerged by flooding waters.

Even with these operational problems, the wooden railroad cross tie still holds a dominant market share of about 90 percent in America. The remaining market share is comprised of precast concrete ties with a steel tie plate or chair cast into the upper surface of the cross tie, extruded or molded plastic ties with the metal tie plates being spiked or screwed into the plastic during field installation and the least common being stamped or forged steel ties with means for attaching the rail directly to the metal cross tie without the use of additional tie plates being screwed onto the steel cross tie.

Concrete is the second most common cross tie material in North America. Concrete cross ties are more prevalent in Europe and in high-speed passenger applications throughout the world. Concrete tie systems typically use over-center tension clips, such as made by the firm Pandrol, for affixing the rail to the molded-in metal tie plate on the upper surface of the concrete tie. Also, there are limited examples of the rail track structure being a monolithic concrete bed that uses no sleepers or ties whatsoever. These sleeperless or slab style installations are used for very high speed and tunnel applications where maintenance is difficult to perform or where thermal stresses from significant temperature variations are less prevalent. Concrete sleeper and slab style track systems are significantly more expensive to install than wooden tie systems but carry the expectations of increased safety and lower lifecycle costs relative to wooden tie systems. Concrete track structure and concrete cross ties have demonstrated less than expected life cycle duration with problems such as rail seat deterioration, cracking from cyclical or impact loads, surface water retention and freeze-thaw spalling.

Plastic or composite is the third most common cross tie material in North America. They are typically more expensive than wood and about the same or slightly higher in price than concrete. Plastic cross ties are difficult to manufacture in high volumes, have problems with surface cracking, have less resistance to side shifting than wood or concrete, are more flexible than wood, not as strong as wood or concrete and not desirable for high speed passenger service.

The predominant means for affixing consecutive sections of steel rail is butt-welding them together for a connected length being as much as a kilometer or longer. The single piece of welded rail is then installed onto the tie plates and independent cross ties. Continuous Welded Rail (aka CWR) or ribbon rail can be stronger than sectioned rail and can be less maintenance intensive. CWR is different than the historic method, which had a mechanical joint at every rail section. It is the steel wheels of the train cars rolling over the gaps in the section joints that result in the signature "clickity-clack" sound familiar to train transportation in the past.

There is an intrinsic and serious problem with CWR that does not occur with sectioned rail that uses conventional expansion joints. Steel rail expands in length when it is heated and contracts in length when cooled. This thermal expansion or contraction can be significant enough to cause rail track failure in hot conditions by twisting out of shape (aka sun kinks) and even snap in cold conditions (aka pull-a-parts). The thermal coefficient of expansion for steel is 0.00000645 inches of expansion/contraction per inch of length per degree of temperature change in Fahrenheit. For a one mile section of track and a 100-degree temperature variation the change in length for an unrestrained section of track is approximately 40.6 inches. It is possible for many rail track sections in the American Midwest to experience a 200-degree temperature variation over a 12-month period, due to the deep sub-zero F ambient winter temperatures and the elevated ambient summer temperatures plus radiant heat absorption from direct sunlight.

To avoid temperature related shifting of the track bed, physical distortion of the rail and interrupted service or derailment, it is preferred for CWR to be laid on concrete sleepers. The extraordinary weight of the concrete sleeper can be useful in holding the rail in place against the thermally induced stresses. CWR is frequently installed on wooden tie track systems, which creates persistent maintenance activity in anticipation of rail movement. During the hot summer months, train rail is routinely cut to relieve the built up stress and then re-welded. During the winter period the track has to be heated in order for pull-a-parts to be mended by re-welding. When new track is laid or whole sections replaced, it is usually heated to an estimated neutral temperature for that locale. This pre-heating technique attempts to minimize the expected repair work. The unsolved problem of thermal stresses in CWR systems requires persistent, ongoing repair. It is common practice for inspectors to walk or ride the track systems and physically examine the rail when the weather conditions warrant.

The rock ballast in the track bed has a tendency to settle and subside due to use over time, weathering effects, thermally induced loads and lateral forces on the as trains go through curve sections. All three primary railroad ties (concrete, wood and plastic) typically have a nominally rectangular, solid cross section. Maintenance of the ballast rock bed and keeping up the edges or shoulders of the ballast bed on the outside of the ends of the ties is vital. When the forces horizontal and perpendicular to the steel rail occur, it is the friction force due to the weight of tie and track plus any resistance by ballast rocks outside the tie ends that resists shifting. Since current sleeper designs are nominally rectangular and solid in cross-section, correcting subsidence of the ballast rock bed at the rail bed shoulder and keeping the ballast rock bed intact is an important maintenance function.

Concrete ties are considerably more expensive than wood, do not co-mingled with other tie types and more commonly found in new construction. Concrete ties, due to their weight, require different equipment for handling and installation than regular wood or plastic molded ties. Concrete ties are susceptible to stress cracking from the wheel loads moving across the tie and often have cushioning pads between the metal rail seat and the bottom of the steel rail. Concrete ties are steel reinforced to absorb the tension or bending loads that can occur on the ties. Concrete ties do not absorb vibrations as well as other ties. Concrete ties can have accelerated failure due to incorrect cement recipes, insufficient curing time or environmental degradation. Concrete ties do not attenuate the wheel to rail noise as well as wood or plastic.

Plastic cross ties are more expensive than wood and not readily available in large quantities. Plastic ties are more likely than concrete or wood to shift from side loads due to a lower weight and low relative coefficient of friction with the rock ballast.

Wood cross ties are the least expensive but have the shortest expected life cycle before needing replacement. Wood ties are more subject to weather related degradation. In certain locations like Africa wood ties cannot be used due to rapid destruction from insects like termites. Wood ties are more likely to release the spike or screws that hold the rail to the tie plate and thus subject to vandalism. The toxic preservatives used to extend the life of wood ties leach out over time and contaminate the environment.

The thermally induced stress in steel rail is a universal problem and well understood. Expensive and elaborate expansion joints with special clips like the Pandrol Zero Longitudinal Restraint can be currently found in the more vulnerable and valuable track sections of high-speed passenger lines, such as bridges, tunnels and curves. Full resolution of the thermal stress problem can be accomplished by the frequent use of expansion joints along the full track length. Utilizing current design expansion joints would greatly increase the installed costs of the already expensive concrete tie track systems. Increased cost is the primary barrier to solving this thermal expansion problem.

SUMMARY OF THE INVENTION

A train rail track structure system disclosed includes a steel channel cross tie comprising a wider top web side and two narrower sides disposed at right angles downward from the wider top web side, the narrower sides defining at least one of a plurality of holes, tabs and notches proximal to each longitudinal end of the steel channel cross tie. The system also includes a steel channel connecting link defining at least one of a plurality of holes, tabs and notches complementary to the steel channel cross tie holes, tabs and notches proximal to both longitudinal ends of the steel channel connecting link configured to interleave with at least one steel channel cross tie and interlock the steel channel connecting link to the steel channel cross tie.

A disclosed train rail track structure system includes a c-face down steel channel cross tie defining a plurality of holes in a top wider web surface thereof and a protrusion with a plurality of perpendicular faces extending from an underside of the top surface, the holes configured to pass a fixative and solidifying mixture into a ballast bed there beneath and the protrusion with perpendicular faces configured to anchor the steel channel cross tie in the fixative and solidifying mixture and the ballast bed. The disclosed system also includes a c-face down steel channel connecting link defining a receptacle for at least one intermediate rail support member in a top wider web surface thereof and also defining one of a plurality of tabs and notches proximal to both longitudinal ends of the steel channel connecting link configured to interleave with at least one steel channel cross tie and interlock the steel channel connecting link to the steel channel cross tie.

A disclosed method of making a train rail track structure system includes forming a steel channel cross tie comprising a wider top web side and two narrower sides disposed at right angles downward from the wider top web side, the narrower sides defining at least one of a plurality of holes, tabs and notches proximal to each longitudinal end of the steel channel cross tie. The method of making also includes forming a steel channel connecting link defining at least one of a plurality of holes, tabs and notches complementary to the steel channel cross tie holes, tabs and notches proximal to both longitudinal ends of the steel channel connecting link configured to interleave with at least one steel channel cross tie and interlock the steel channel connecting link to the steel channel cross tie.

Other aspects and advantages of embodiments of the disclosure will become apparent from the following detailed description, taken in conjunction with the accompanying drawings, illustrated by way of example of the principles of the disclosure.

Figure 1:
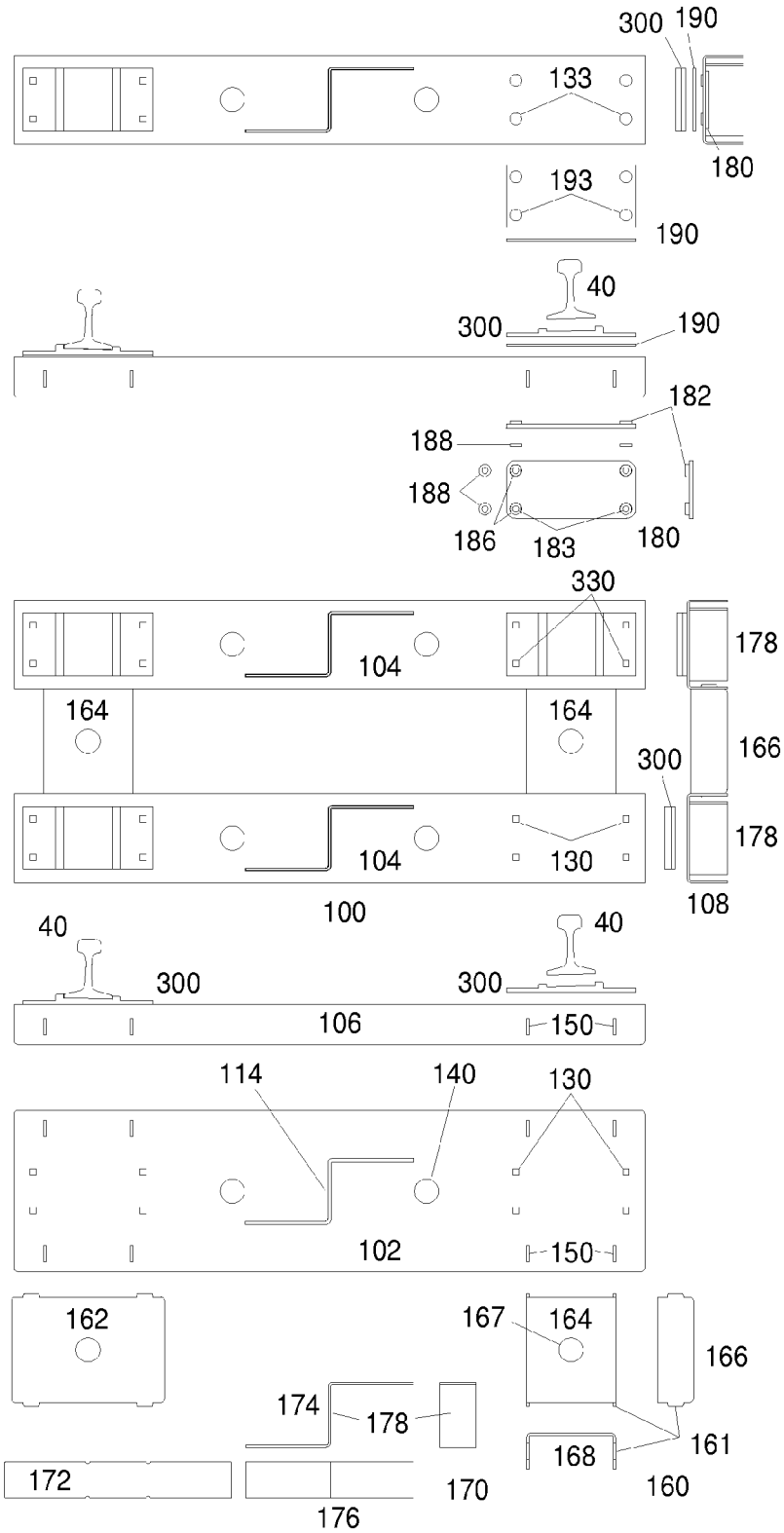
FIG. 1 depicts a train rail track structure system comprising formed steel channel cross ties and formed steel channel connecting links in accordance with an embodiment of the present disclosure.

Throughout the description, similar or same reference numbers may be used to identify similar or same elements in the several embodiments and drawings. Although specific embodiments of the invention have been illustrated, the invention is not to be limited to the specific forms or arrangements of parts so described and illustrated. The scope of the invention is to be defined by the claims appended hereto and their equivalents.

DETAILED DESCRIPTION

Reference will now be made to exemplary embodiments illustrated in the drawings and specific language will be used herein to describe the same. It will nevertheless be understood that no limitation of the scope of the disclosure is thereby intended. Alterations and further modifications of the inventive features illustrated herein and additional applications of the principles of the inventions as illustrated herein, which would occur to one skilled in the relevant art and having possession of this disclosure, are to be considered within the scope of the invention.

This patent application concerns novel train rail track structure systems and components for use while traveling on the ground and when elevated above the ground. The application of these novel components and track structures are useful in but not limited to freight and passenger train service, trolleys, personal transport vehicles, cranes, gantries and other steel wheel on steel rail track applications. This system includes new design cross ties, integrated sections of track assembled from the new design cross ties, methods of manufacturing the new design cross tie, improvements for constructing an integrated steel rail track system, improvements for managing thermally induced stress in the steel rail, methods for constructing elevated train rail track structure sections, unique design track sections for elevated train travel and other novel improvements for use generally and not exclusively in the field of steel wheel on steel rail track structures.

This patent application describes novel improvements to train rail track structures that solve long-standing problems inherent in current train rail track structures, whether they are comprised of existing wood, concrete, plastic, composite or steel cross ties or monolithic/slab track construction. This novel track structure system can reduce total acquisition cost of new track systems, reduce overall track maintenance, eliminate endemic safety problems, increase operational performance, adapt to changing weather and temperature variations, can be used in all environmental conditions and provide greater life cycle versus other track system designs.

When used separately or combined as a system the improvements and novel designs disclosed herein will: (1) result in lower installed costs than a new wood tie, concrete tie, plastic tie, conventional steel tie or concrete slab style track systems, (2) be stronger, stiffer, more durable and weather resistant, (3) attenuate vibration and noise as well as wood or plastic, (4) be as precise in rail positioning as concrete ties or concrete slab style track systems, (5) facilitate the elimination of thermally induced stresses, (6) be impervious to insect attack, (7) eliminate environmental contamination from wood preservatives being leached out over time, (8) greatly reduce track maintenance and related costs, (9) eliminate common theft/vandalism of loose tie plates and spikes, (10) increase operational performance, (11) dramatically reduce installation time for new or repaired track, (12) reduce operating costs, (13) reduce or eliminate periodic reconstruction of the track structure and (14) increase passenger and public safety.

FIG. 1 depicts a train rail track structure system comprising a single formed steel channel connecting link and formed steel channel cross ties, Item 100 in accordance with an embodiment of the present disclosure. This design cross tie could be manufactured from other metals, materials and methods and is not limited to steel or the bending of flat sheet to produce the final shape. Item 102 is a flat sheet representation of the cross tie, Item 100, before forming. Item 104 is a top view of the cross tie after forming, Item 108 is an end view of the cross tie after forming. Item 106 is a side view of the cross tie after forming. Item 130 are various square holes found throughout Item 102 used for mounting Item 300, the steel rail tie plate, to the top of Item 104.

Item 114 is an S-shaped slot cut into the flat sheet, Item 102, of the formed channel cross tie, Item 100. The dimension and width of the Item 114 allows for receiving the S-shaped bracket Item 170 after Item 100 has been formed. After the flat sheet Item 102 has been formed into a channel, an S-shaped to bracket, Item 170, is placed within the corresponding slot, Item 114, and welded along the complete length of Item 114, thereby fusing Item 170 with Item 100. When the formed channel cross tie has been completed with the welding addition of the S-shaped bracket, it has greater bending strength to resist the weight of the passing train and superior engagement with the underneath rock ballast bed to prevent side shifting of the train rail track structure. Alternative shapes and methods of construction could be employed to produce similar functional benefits as the S-shaped bracket. A small section of an H-beam (with its flange width being less than the interior width of the cross tie and its length being the same as the height cross tie) could be similarly received into a receptacle slot and welded to the top surface of the cross tie. The primary function of the S-shaped bracket is to be an anchor into the middle of the ballast bed so that lateral loads that attempt to shift the track structure from its centerline are resisted left and right from the middle of the track structure.

Item 170 is the formed steel S-shaped bracket that fits within Item 114 after Item 100 has been formed. Item 174 is a top view of the S-shaped bracket after forming. Item 176 is a side view of the S-shaped bracket after forming. Item 178 is an end view of the S-shaped bracket after forming. The vertical height of Item 170 is essentially the same as the vertical height of the formed channel cross tie, Item 100.

After the flat sheet Item 102 has been formed into a channel, an S-shaped bracket, Item 170, is placed within the corresponding slot, Item 114, and welded along the complete length of Item 114, thereby fusing Item 170 with Item 100. When the formed channel cross tie has been completed with the welding addition of the S-shaped bracket, it has greater bending strength to resist the weight of the passing train and superior engagement with the underneath rock ballast bed to prevent side shifting of the train rail track structure.

Symmetric holes, Item 140, located along the centerline of each Item 100 are used for positioning and locating consecutive cross ties, Item 100, or welded assemblies of cross ties. Item 150 are depicted as rectangular slots in Item 100 that when formed into a channel will be on the opposing vertical sides of Item 100. Item 150 are specifically spaced apart for receiving a portion, Item 161, of the formed channel connecting link, Item 160, for welding between consecutive Items 100.

Item 160 is a formed channel to be used as a connecting link between consecutive Items 100. When welded together as unit, the cross ties, Item 100, and connecting links, item 160, will comprise an integrated track section of known length and spacing. Item 162 is a depiction of the flat sheet of material that when formed into a channel results in a completed Item 160. Item 164 is a top view of the formed channel Item 160. Item 166 is a side view of the formed channel Item 160. Item 168 is an end view of the formed channel Item 160. Item 161, tabs on the vertical legs of Item 160, are specifically sized and spaced apart for inserting within the slots, Item 150, on the vertical portions of Item 100.

In the upper right corner of FIG. 1 is an alternate means for mounting Item 300 steel tie plates to the formed channel cross tie, Item 100. Item 190 is an insulation or isolation pad mounted between the steel rail tie plate, Item 300, and the top surface of the formed cross tie, Item 104. Item 190 is comprised of flexible, compressible plastic or rubber bearing material that absorbs the weight of the passing train wheels, attenuates noise and electrically insulates the steel rail, Item 40, from the steel cross tie and the ground when used in conjunction with Item 180. Item 190 has four holes, Item 193, that are concentric with and corresponding to the four square holes, Item 330, in the steel tie plate, Item 300, the four holes, Item 133, in the top surface of the alternate steel cross tie and the four through holes, Item 183. The four holes, Item 193, have essentially the same diameter as the four holes, Item 133.

Item 180 is comprised of a rigid and strong plastic bearing material that cooperates with Item 190 in locating and precisely affixing Item 300 on to the alternate formed channel cross tie. Item 180 has four cylindrical bosses or extensions, Item 182, that protrude up and through corresponding holes, Item 133, in the formed channel cross tie. The distance of Item 182 above the upper surface of the alternate Item 100 is slightly less than the thickness of Item 190. When Item 300 is completely bolted together with Item 190 above the alternate formed channel cross tie, Item 100, and Item 180 below, a slightly compressed or preloaded condition exists in Item 190. The diameter of Item 183 is just slightly less than the diameter of hole, Item 193. Also shown in the upper right corner of FIG. 1 are steel washers, Item 188 that fit flush within recesses, Item 186, in the bottom surface of Item 180 for use with nuts that are threaded onto the ends of the square shoulder or carriage bolts that pass through holes, Item 330, and holes, Item 183. It is anticipated that Item 188 will be cut from the material leftover from the cutting of holes, Item 133.

Figure 2:
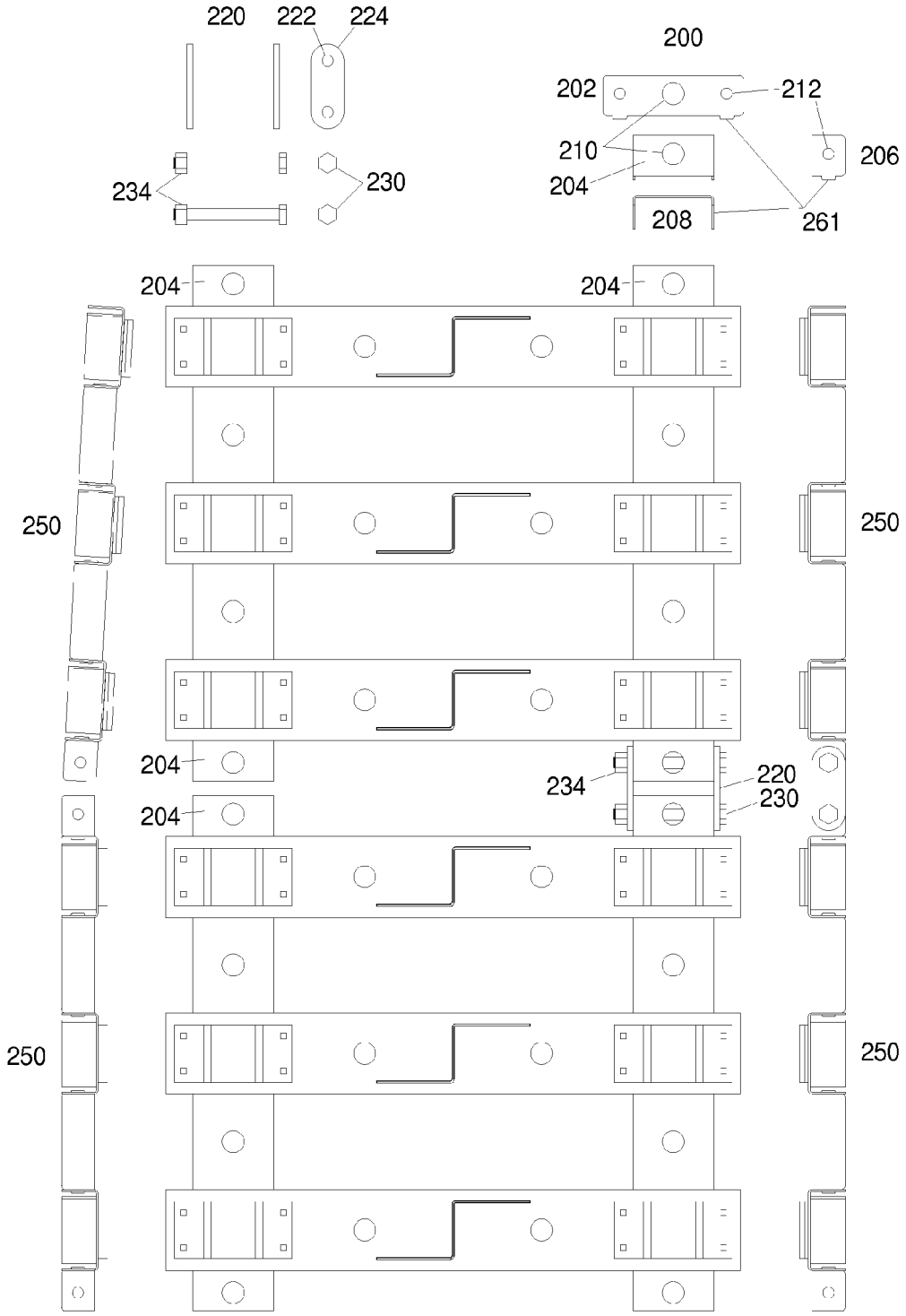
FIG. 2 depicts two straight arrays of three formed steel channel cross ties welded to connecting links to form a complete unit in accordance with an embodiment of the present disclosure.

FIG. 2 depicts two straight arrays of three (3) Item 100 formed steel cross ties welded to connecting links to form a complete unit, Item 250 in accordance with an embodiment of the present disclosure. Item 200 are formed steel channels that function similarly to one half of an Item 160 as depicted in FIG. 1. Item 261 tabs are to be received within the Item 150 slots for relative location prior to each Item 200 being welded to its corresponding Item 100. Item 210 is a hole on the top surface, Item 204. Item 212 are opposing holes on the vertical legs, Item 206. The opposing holes, Item 212 are sized to receive Item 230 bolts that pass through. Item 220 are flat link plates that mount on the outside legs, Item 206, of opposing Items 200 from one section Item 250 to another section Item 250. Item 230 is a common bolt or threaded fastener that goes through Item 222 of one opposing Item 220, through both holes Item 212, through Item 222 of an opposing Item 220 and is affixed with a common threaded nut, Item 234. Each Item 220 has a semi-circular end, Item 224, concentric with Item 222.

The welded assembly of consecutive Items 100 into a common track section, Item 250, has significant functional advantages such as adding strength in resisting side loads from thermal expansion of the steel rail, superior retention of the ballast within the bed cross section, superior grip or engagement of the track structure with the ballast bed and superior distribution of the weight of the passing train to the ballast bed beneath the track structure. Connecting consecutive Item 250 sections in the manner depicted in FIG. 2 with Items 220 further enhances the described above structural benefits and facilitates vertical transitions of the train rail coming onto and leaving bridge structures and other features.

Constructing the track structure underneath the train rail from Item 100 members of formed steel channel that are "C-Face Down" has functional benefits unknown to individual cross ties of wood, concrete or plastic with a uniform, solid cross section or conventional steel cross ties with an angled or shovel-nose closed end. The Item 170 S-shaped bracket within the Item 100 formed channel cross tie engages the ballast rock bed from the centerline resisting side shifting equally in both directions and fully captures the ballast rock preventing eruption under side load. The formed steel connecting channels, Item 160, are likewise "C-Face Down" and engage the ballast bed across its full width and not just the shoulders of the ballast as do conventional, individual cross ties of wood, plastic, concrete or steel. The connection of consecutive sections, Item 250, with Items 200, Items 220, Items 230 and Items 234 results in an integrated, continuous, robust structure that mechanically links all cross tie positions throughout the length of the track independently of the steel train rail.

Figure 3:
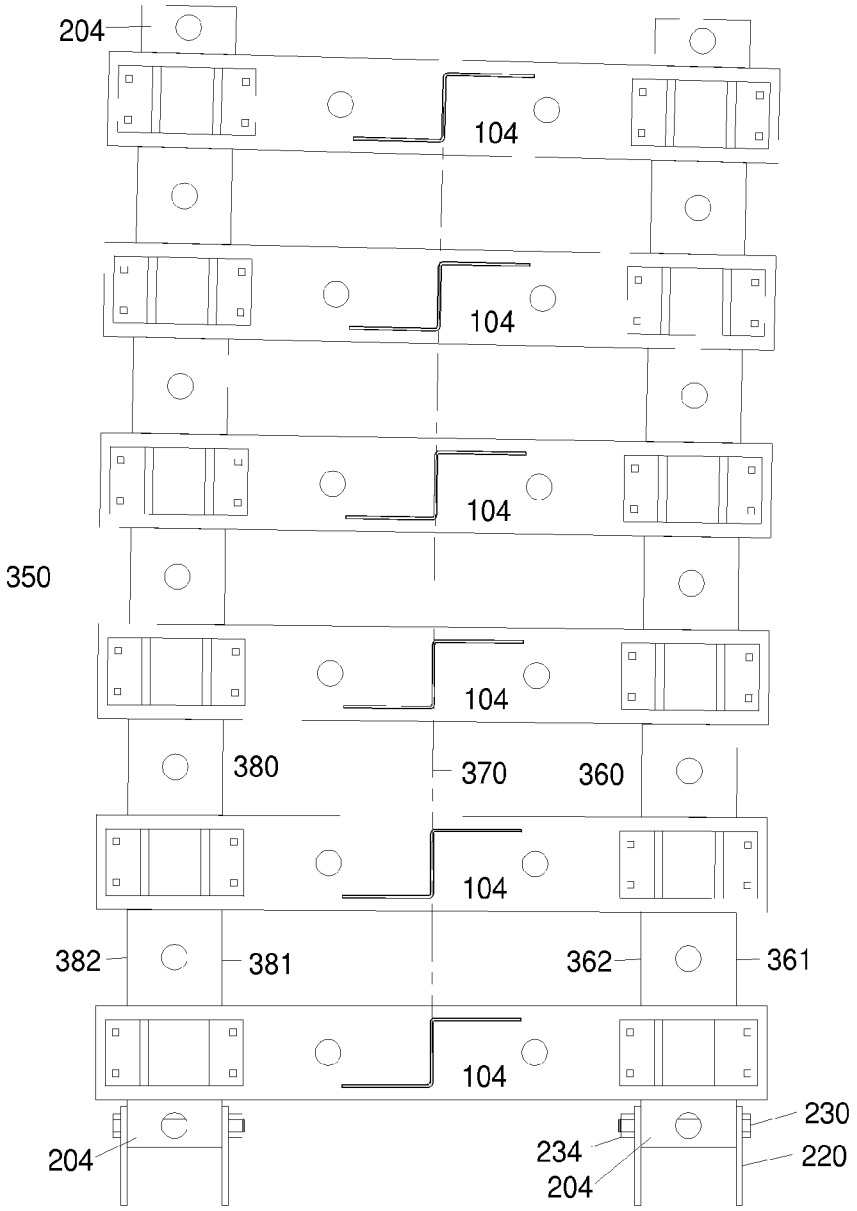
FIG. 3 depicts an angular, continuous sweep radius array of six formed steel channel cross ties connected into a common curve segment in accordance with an embodiment of the present disclosure.

FIG. 3 depicts an angular, continuous sweep radius array of six (6) Item 100 formed steel channel cross ties connected into a common curve segment, Item 350 in accordance with an embodiment of the present disclosure. Item 380 is the outside radius formed channel connecting links for welded attachment of cross ties into a common curve segment. Item 381 is the inside edge or chord length of Item 380 and Item 382 is the outside edge or chord length of Item 380 used in the construction of Item 350 with a uniform sweep radius, Item 370. Item 360 is the inside radius formed channel connecting links for welded attachment of cross ties into a common curve segment. Item 361 is the inside edge or chord length of Item 360 and Item 362 is the outside edge or chord length of Item 360 used in the construction of Item 350 with a uniform sweep radius, Item 370. The connection of two consecutive Item 350 curves section is anticipated to use common Item 200 half channel connecting members, Item 220 links, Item 230 bolts and Item 234 nuts. The number of cross ties assembled into a common curve segment, the centerline radius of curvature and the angular spacing between each cross tie, Item 100, can and will vary depending on the application.

Figure 4:
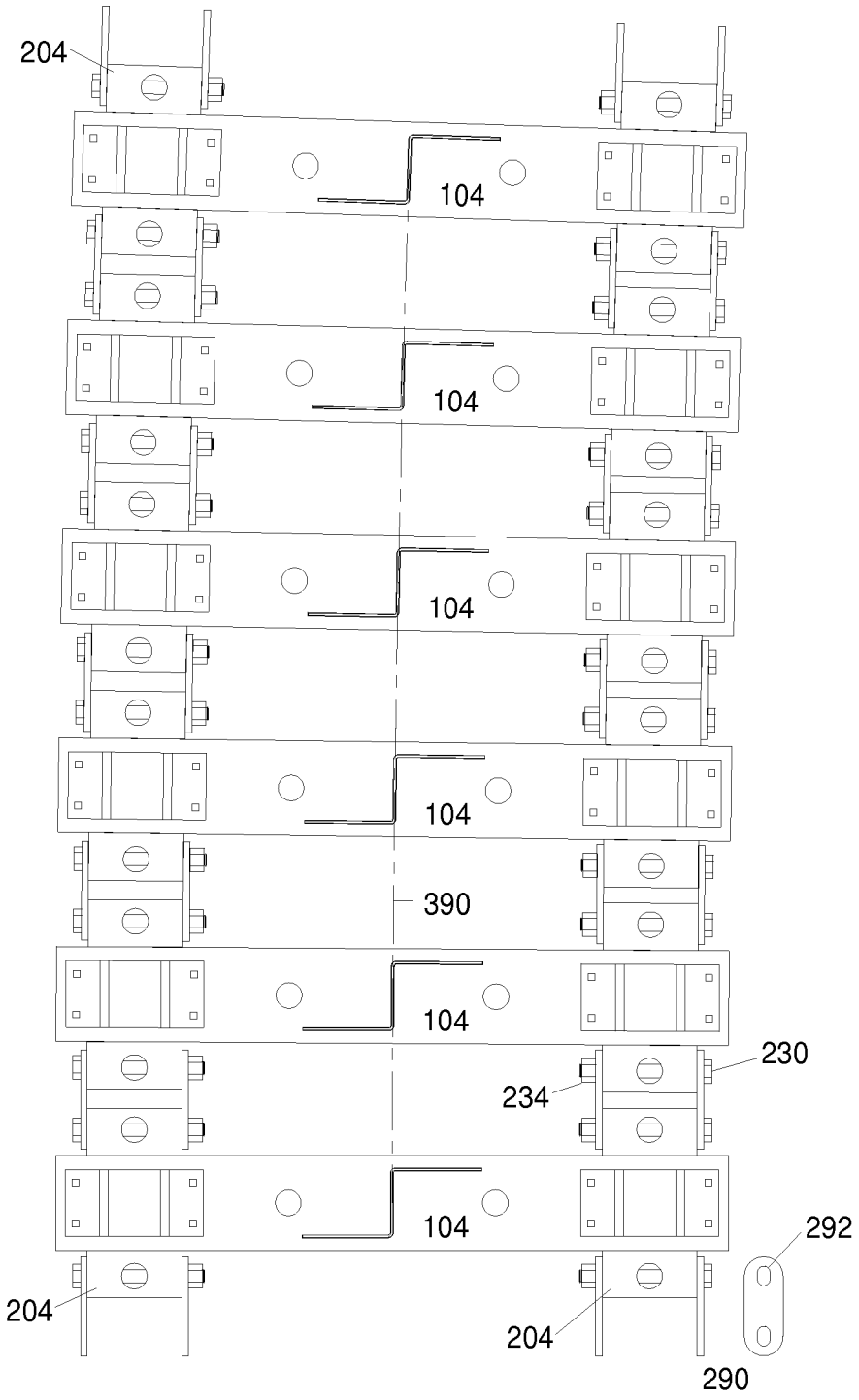
FIG. 4 depicts another type of sweep radius curve utilizing formed steel channel cross ties and formed steel channel half connecting links in accordance with an embodiment of the present disclosure.

FIG. 4 depicts another type of sweep radius curve utilizing Item 100 formed channel steel cross ties and formed steel channel half connecting links in accordance with an embodiment of the present disclosure. In this representation only Item 200 channels are welded to the opposing vertical legs of Item 100. Connecting the consecutive Item 100 formed channel cross ties are Item 290 link plates, which are similar to Item 220 link plates as depicted in FIG. 2. In this case, there are oblong slots, Item 292, that function similarly to the Item 222 to round holes found in Item 220. Item 230 bolts and Item 234 nuts are used in conjunction with Item 290 link plates to connect consecutive Item 100 cross ties. In this depiction a sweep radius of curvature Item 390 is shown. The distance between the semicircular ends of the oblong slots, Item 292, allow for the Item 230 bolts to shift within the Item 292 slots so that a sweep radius curve with an Item 390 radius curvature can be configured.

Figure 5:
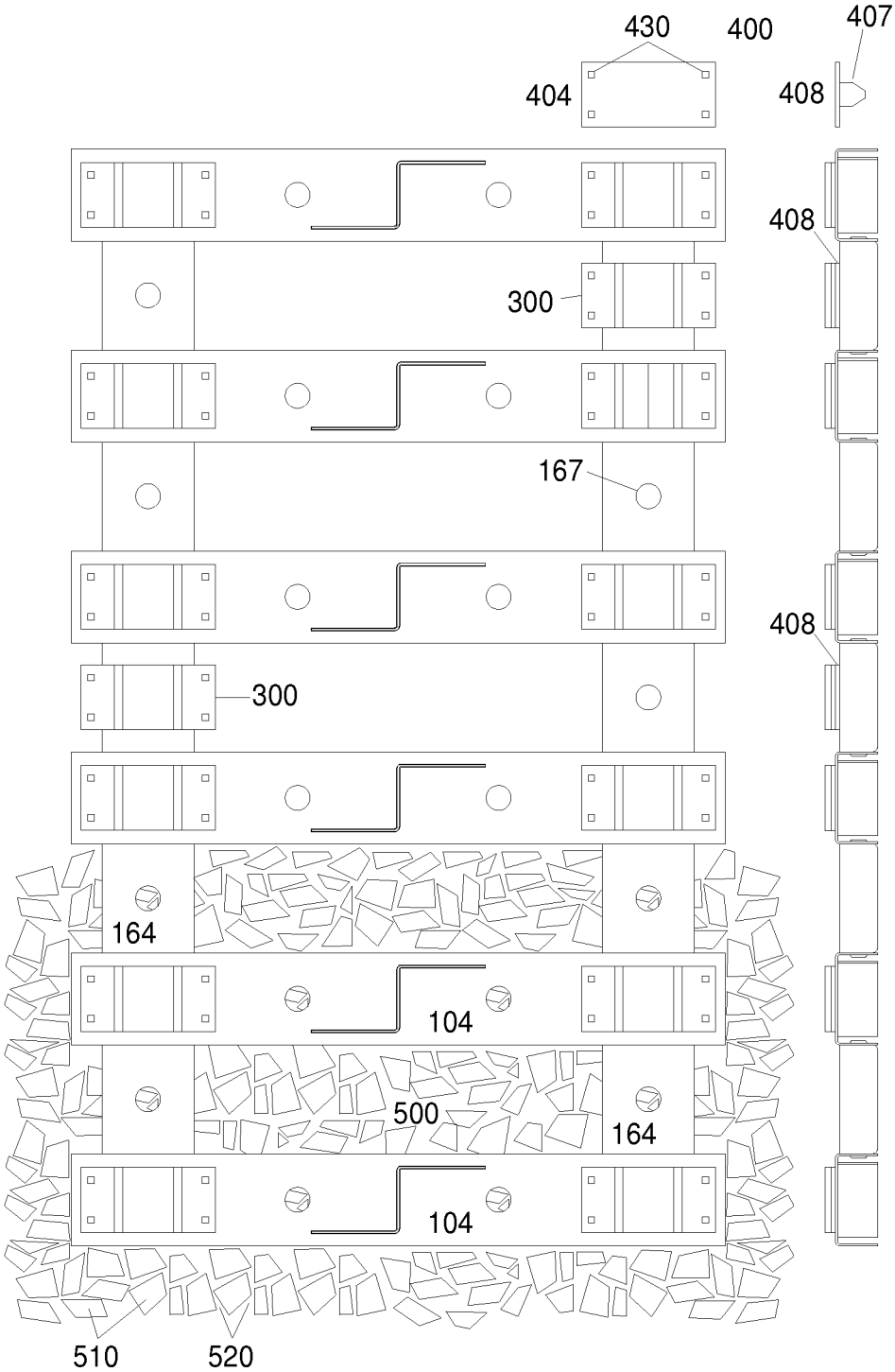
FIG. 5 depicts a device useful in managing thermal stresses in steel rail track systems in accordance with an embodiment of the present disclosure.

FIG. 5 depicts a device, Item 400, useful in managing thermal stresses in steel rail track systems due to weather related temperature variation in accordance with an embodiment of the present disclosure. Even though various different expansion joints are known in the industry, another unresolved problem is preventing the rails from bunching up over time. This shifting of the train rails, usually in the dominant direction of the train travel, can close the range of adjustment in expansion joints rendering them of no benefit to physically accommodate the steel rail thermal expansion. Item 400 would be mounted underneath and nearest to the center point of a steel rail section, Item 40, and between two cross ties, Item 100. Item 408 is a side view of Item 400. Item 407 is a solid steel rod with a tapered end, center located and welded to the bottom surface of Item 400. The major diameter of Item 407 is slightly less than the diameter of Item 167, found on the upper surface of Item 160. It is intended that when Item 160 is welded to Item 100, Item 167 will be located immediately underneath and centered under the steel rail Item 40. Item 430 are holes of the same relative position and size as the holes found on the conventional steel tie plates, Item 300. Once Item 400 is in its proper location, flush and resting atop an Item 160, a steel tie plate, Item 300, will be bolted to Item 404, the upper surface of Item 400. The tie plate is then mechanically and rigidly affixed to the bottom of the train rail such that Item 407 resides within Item 167 and resists fore and aft movement of the steel rail Item 40. The configuration and application of Item 400 in conjunction with Item 300 can also add resistance to side flexing of the steel rail, Item 40, when under thermally induced stress.

In the lower portion of FIG. 5 there is a pair of formed channel cross ties, Item 104, and related formed channel connecting links, Item 164, which are depicted within a common bed, Item 500, of ballast rocks, Item 510. In a typical train rail application the common wood or concrete cross ties are individually arranged within the ballast bed of rocks, Item 500. These rocks, Item 510, are of a particular size and faceted shape to resist settling when loaded vertically and slippage when loaded horizontally. Because of the size and shape of ballast rock, Item 510, there is considerable space, Item 520, between the individual rocks.

Different than the monolithic concrete slab track found in high speed passenger train applications of Europe, Japan and China, another novel feature of this application is the injection within these spaces, Item 520, of a flowable mixture that will quickly set and integrate the ballast rocks, Item 510, into a monolithic substructure underneath the network of steel formed channel cross ties. This combined arrangement of a steel superstructure of formed steel channel cross ties, Item 100 and Item 160, on top of and in conjunction with a monolithic bed of integrated ballast rock is unique and superior to concrete slab track and individual concrete cross ties, both of which have steel reinforcing means deep within the concrete elements. Premature failure of concrete cross ties, such as freeze-thaw cracking, rail seat deterioration and decoupling of the interior steel reinforcing members within concrete cross ties due to corrosion, are widely known and unsolved problems. Certain and various compositions for this binding or setting mixture, along with the means and methods for injecting this mixture to create the monolithic substructure of ballast rock underneath and incorporating the network formed steel cross ties are contemplated and included in this disclosure.

Figure 6:
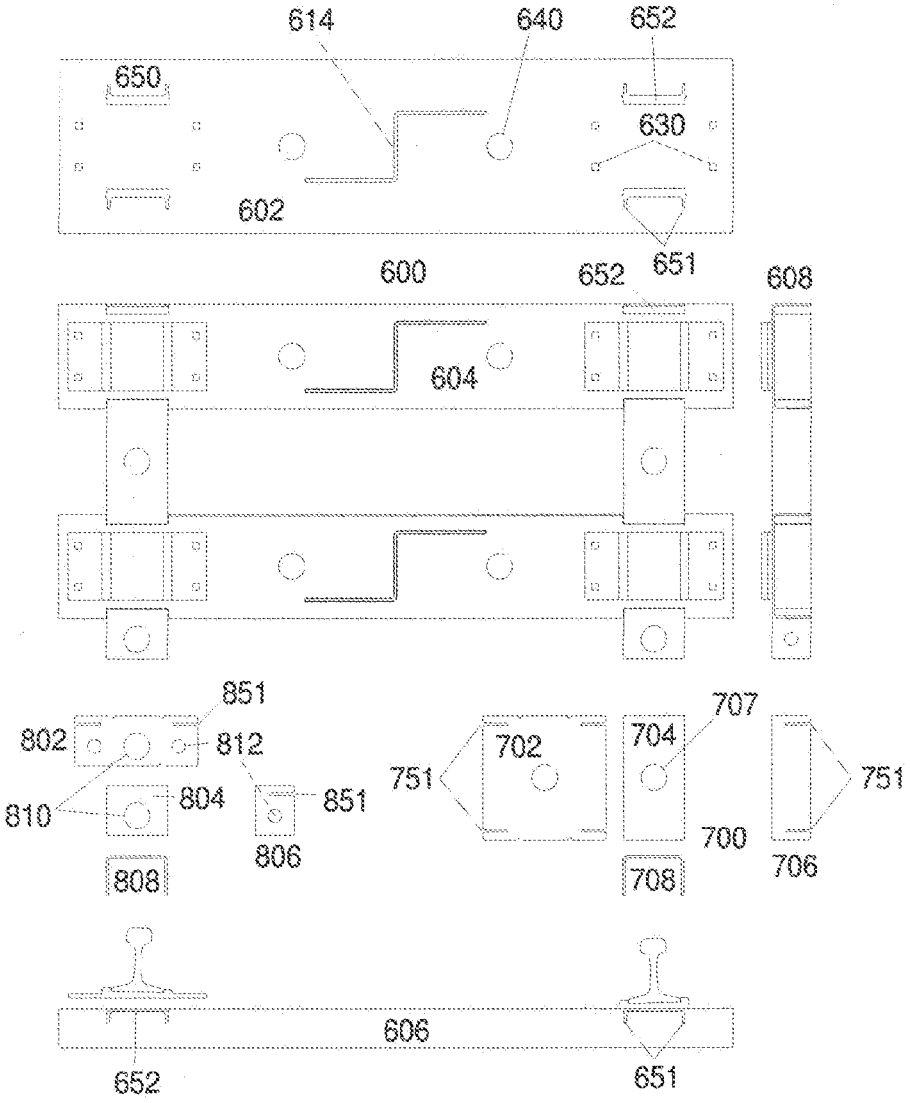
FIG. 6 depicts an alternate version of a formed steel channel cross brace in accordance with an embodiment of the present disclosure.

FIG. 6 depicts an alternate version, Item 600, of the formed steel channel cross brace in accordance with an embodiment of the present disclosure. Item 600 is different than Item 100 in the manner that full length formed channel connecting member, Item 700, and half-length formed channel connecting member, Item 800, engage Item 600. Item 602 is the flat sheet version of Item 600 before it has been formed into a channel. Item 650 is a particular hole pattern that overlaps or straddles the bend line when Item 602 is formed into a channel. After forming there is an opening, Item 652, on the upper surface Item 604. After forming there will be two slits, Item 651, in the vertical legs of Item 600. Corresponding to and fitting intimately within Item 651 would be Item 751 and Item 851. When connected together through the interface of Item 651 with Item 751 or Item 851, there is a physical overlap and not simply an abutting relationship with Item 600. Different that the version depicted in FIG. 1, the top surfaces Item 704 and Item 804 will be flush with Item 604 when fully inserted and engaged with Item 600. Even though there is a mechanical linkage between the members, it is anticipated that Item 800 and Item 700 would be fully welded to Item 600.

Figure 7:
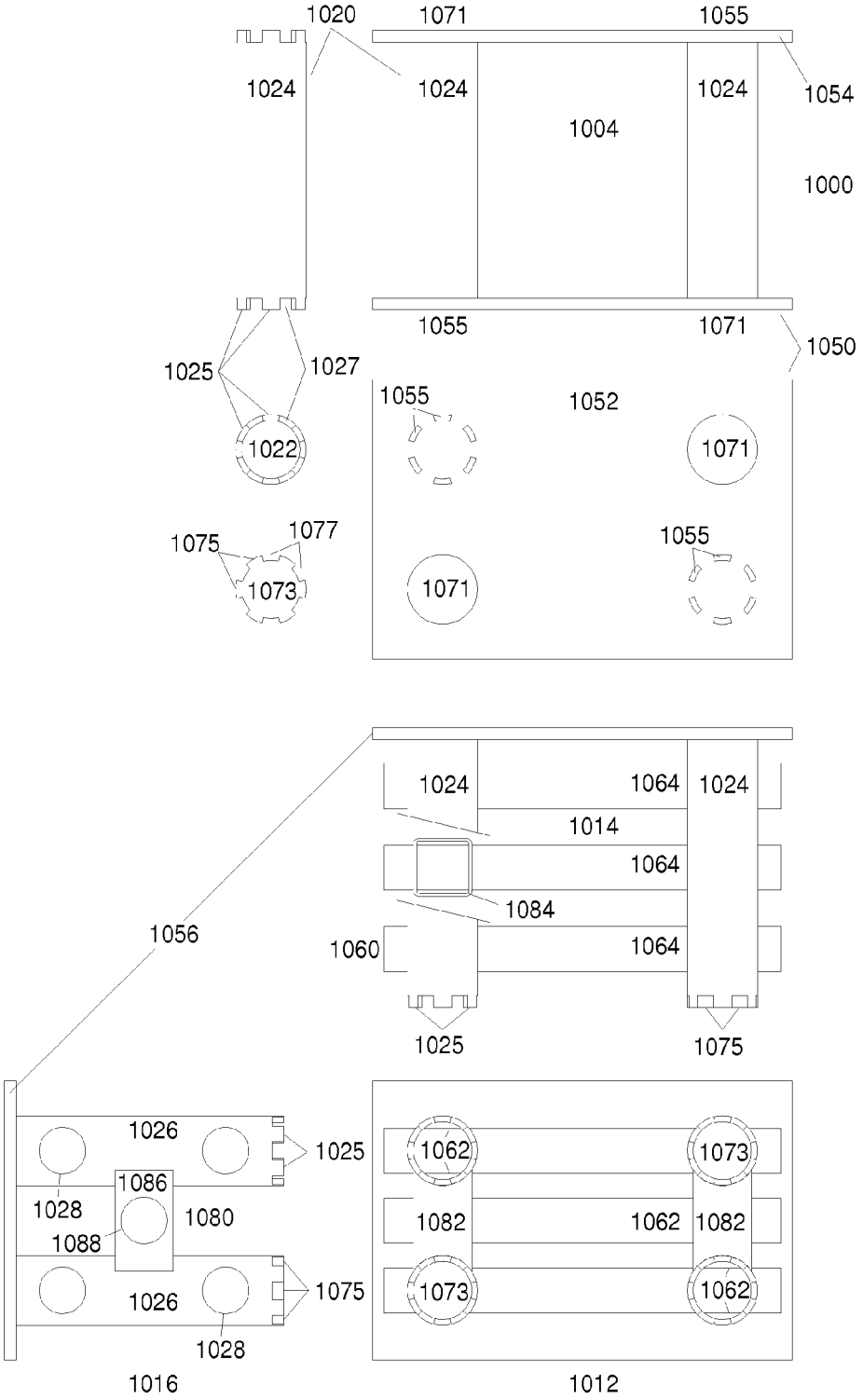
FIG. 7 depicts a general method of assembling horizontal pipe cross members with plate side frames into a completed framework in accordance with an embodiment of the present disclosure.

FIG. 7 depicts a general method of assembling horizontal pipe cross members, Item 1020, with plate side frames, Item 1050, into a completed framework, Item 1000 in accordance with an embodiment of the present disclosure. Item 1004 is a top or plan view of the completed framework, Item 1000. Item 1014 is a top plan view of an incomplete framework with the lower plate, Item 1050 removed for clarity and explanation. Item 1012 is a side view of an incomplete framework with the outside plate, Item 1050 removed for clarity and explanation. Item 1016 is an end view of an incomplete framework with the right hand plate, Item 1050 removed for clarity and explanation. Item 1024 is a plan view of a single Item 1020. In this depiction Item 1024 has certain lugs, Item 1025, that have been cut as a detail onto the end of the pipe with a laser cutter. Item 1027 are the voids between consecutive lugs, Item 1025. Item 1052 is side view of a single Item 1050 on edge with certain reciprocal and complimentary holes or slots, Item 1055, laser cut into the steel plate for receiving the Item 1024 lugs when inserted therein. In this depiction Item 1000 is comprised of two (2) side plates, Item 1050, and four (4) pipe cross members, Item 1020. Utilizing Item 1020 pipe cross members and Item 1050 side plates not only creates an accurate self-fixturing assembly in three dimensions before welding but also prevents a pipe cross member from rotating around its bore centerline. Item 1060 are lateral pipe cross members between consecutive sets of horizontal cross members, Item 1020. The outside diameter of these lateral pipe cross members is slightly less than the holes, Item 1028, in consecutive horizontal cross members, Item 1020. Alternative or in addition to the holes, Item 1028, a vertical saddle, Item 1080, between the upper and lower horizontal pipe cross members can be added. In this depiction Item 1080 is constructed from square metal tubing less than the diameter of Item 1020. It has an upper curved surface to conform to the lower curvature of the upper pipe cross member, Item 1020, and a lower curved surface to conform to the upper curvature of the lower pipe cross member, Item 1020. Item 1088 is a vertical hole through Item 1080 that is the same diameter as Item 1028, which allows for the insertion of a lateral pipe cross member, Item 1060.

Also shown in FIG. 7 on Item 1052 are two (2) completely circular holes, Item 1071. The diameter of these holes, Item 1071 is slightly larger than that the outside diameter of horizontal pipe cross braces members, Item 1020. End plugs, Item 1073, are complimentary and reciprocal in shape and detail to the lugs, Item 1025, and voids, Item 1027, found on the ends of horizontal pipe cross brace members, Item 1020. Items 1073 are anticipated to be cut from the material leftover from holes Item 1071. It is anticipated that pairs of opposing plate side frames, Item 1050, will have alternating hole patterns, so that a horizontal pipe cross braces, Item 1020, will be inserted through Item 1071 of a first plate side frame, Item 1050, extend across and into the receiving holes, Item 1055, of a second opposing plate side frame, Item 1050. Prior to welding the horizontal cross braces, Item 1020, to the plate side frames, Item 1050, an end plug, Item 1073, would be inserted fully within hole, Item 1071, and flush with the external surface of the plate side frames, Item 1050. Consequently, the lugs, Item 1075, would essentially fill the voids, Item 1027 and in a reciprocal manner the lugs, Item 1025, would essentially fill the voids, Item 1077. Using this methodology allows for opposing pairs of plate side frames, Item 1050, to be erected on edge at a predetermined and fixed dimension, the insertion of horizontal pipe cross brace members, Item 1020, fully across and between the plate side frames, Item 1050, and not have to open and close the opposing pairs of plate side frames, Item 1050, in order to fully receive the horizontal pipe cross braces, Item 1020.

The methodology depicted in FIG. 7 has numerous general applications. One of those applications is in the construction of bridge sections for elevated train rail track systems as depicted in FIGS. 8 through 12. Variations of this methodology could be employed in the construction of elevated road surfaces and other general uses. The means and method of construction depicted in FIG. 7 utilizes round steel pipe engaged with flat plate side frames but is not limited or restricted to circular pipe as the horizontal, longitudinal or vertical members. Square tubing, I-beam members, T-beam members and other profiles could be employed in the construction methodology and are anticipated within this scope of this application.

Figure 8:
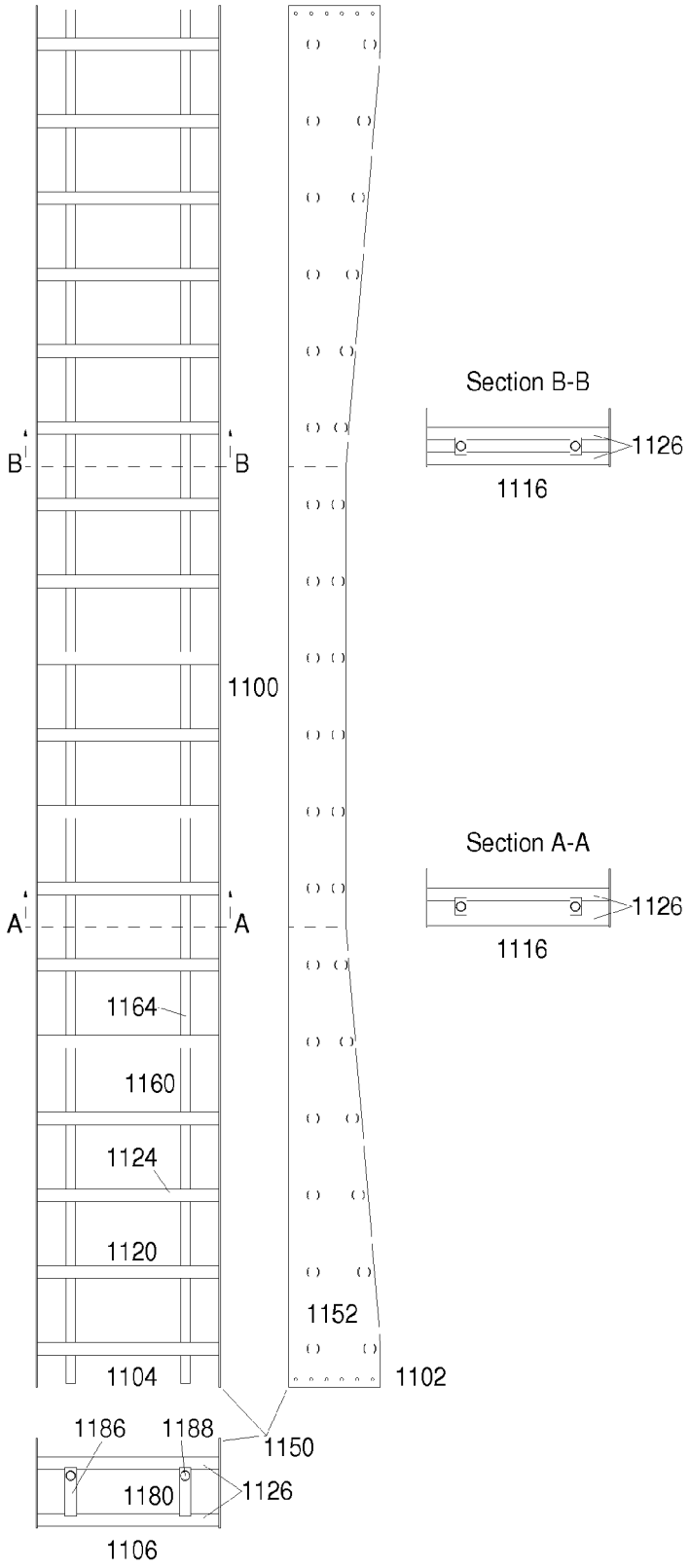
FIG. 8 depicts a larger assembly of horizontal pipe cross members, lateral pipe cross members and flat plate side frames in accordance with an embodiment of the present disclosure.

FIG. 8 depicts a larger assembly, Item 1100, of horizontal pipe cross members, Item 1120, lateral pipe cross members, Item 1160 and flat plate side frames, Item 1150 in accordance with an embodiment of the present disclosure. Different than the depiction in FIG. 7, the horizontal pipe cross members, Item 1120, have only two lugs laser cut into its ends and Item 1150 has only two laser cut receiving holes or slots for accepting Items 1120. At the bottom of FIG. 8 is an end view of the assembly, Item 1100, showing the greater depth of section at each end. Lateral pipe cross members run the complete length of Item 1100 passing through a series of vertical saddles, Item 1180. As seen in Section A-A and Section B-B the vertical relationship between the upper horizontal pipe cross members, Item 1120, and the lateral pipe cross members, Item 1160, is maintained throughout the entire length of Item 1100.

Figure 9:
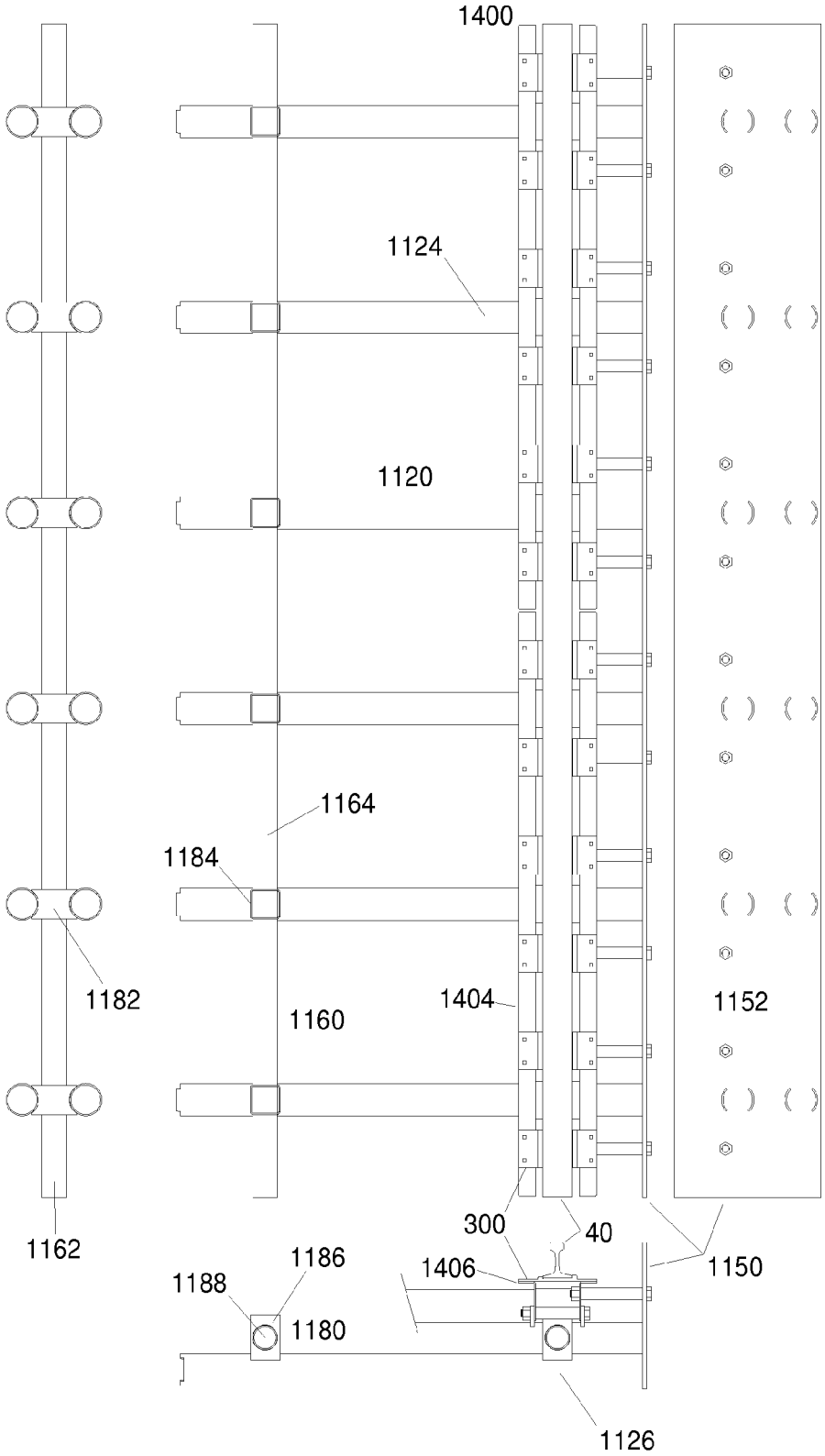
FIG. 9 depicts a portion with the left side plate removed and a portion of the upper horizontal pipe cross members removed for clarity and explanation in accordance with an embodiment of the present disclosure.

FIG. 9 depicts are portion of Item 1100 with the left side plate, Item 1150, removed and portion of the upper horizontal pipe cross members, Item 1120, removed for clarity and explanation in accordance with an embodiment of the present disclosure. Immediately above the right side lateral pipe cross member, Item 1160, in descending order are the train rail, Item 40, which is resting on tie plates, Item 300, which are affixed to assembled track frame, Item 1400. Item 1406 is an end view of Item 1400. Item 1404 is a plan view of Item 1400.

Figure 10:
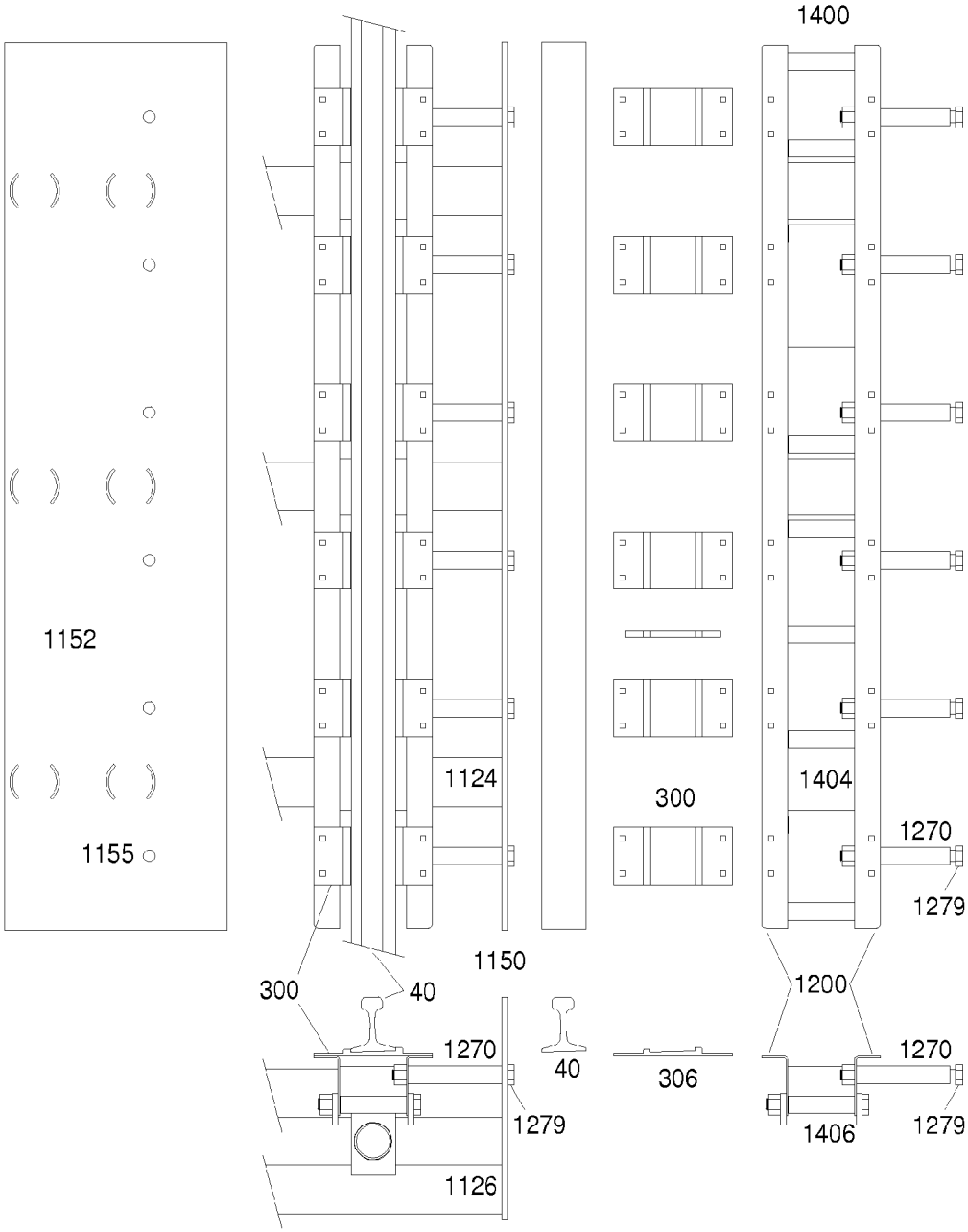
FIG. 10 depicts a zoomed in and smaller view of various items in accordance with an embodiment of the present disclosure.

FIG. 10 depicts a zoomed in and smaller view of various items in accordance with an embodiment of the present disclosure. In progression from left to right, the train rail, Item 40, the tie plates, Item 300 and the track frame, Item 1400 have been extracted for clarity and explanation. Item 1279 is a threaded fastener that penetrates through hole, Item 1155, through a pipe spacer, Item 1270 and through the right angle side frame, Item 1200, which fixes the location of Item 1400 relative to the right side plate Item 1150.

Figure 11:
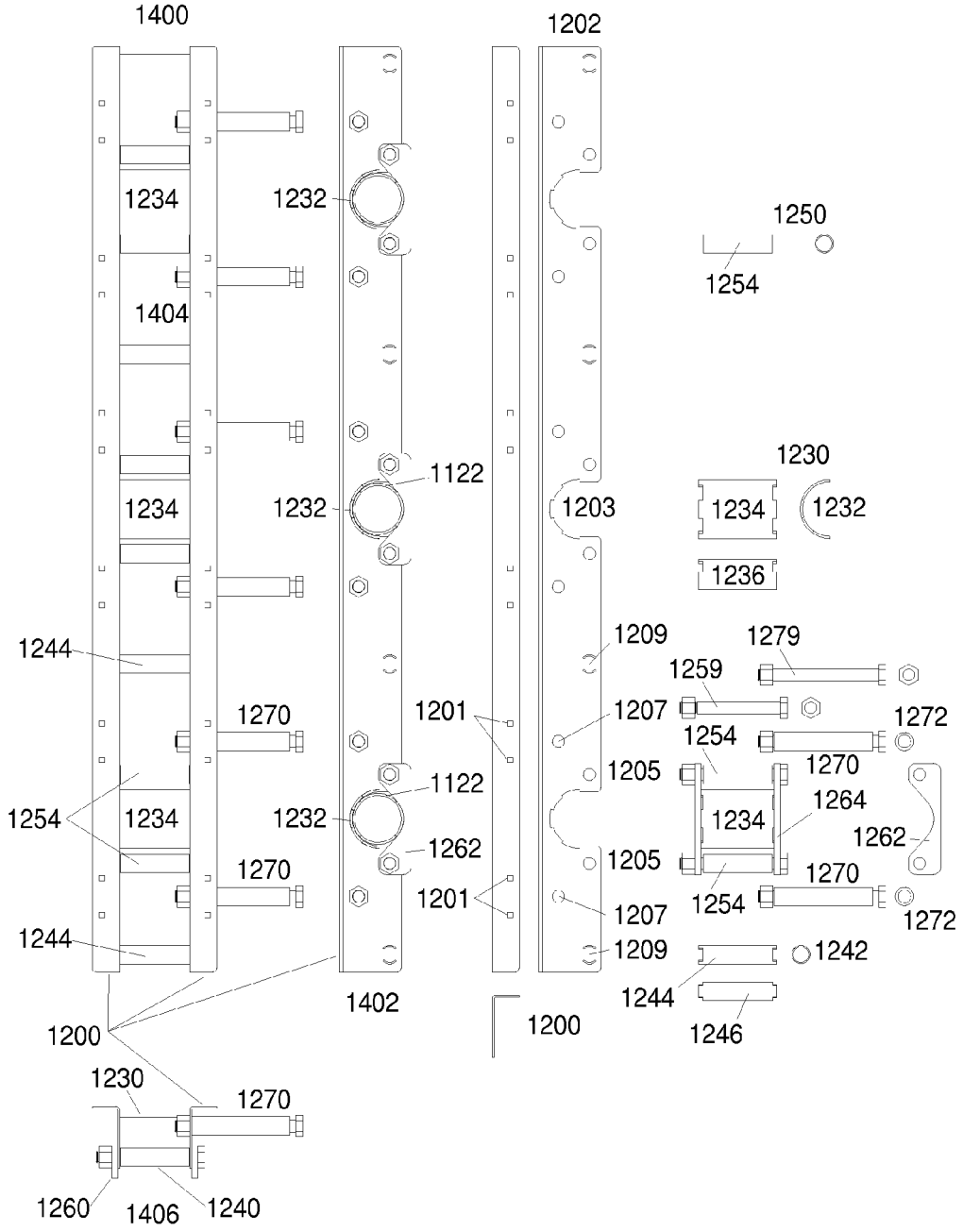
FIG. 11 depicts an assembled track frame without the train rail and the tie plates in accordance with an embodiment of the present disclosure.

FIG. 11 depicts the assembled track frame, Item 1400, without the train rail, Item 40, and the tie plates, Item 300 in accordance with an embodiment of the present disclosure. Item 1404 is a plan view of Item 1400. Item 1406 is an end view of Item 1400, Item 1402 is a side view of Item 1400. Item 1400 includes two (2) formed angle side frames, Item 1200, a left and a right, which are identical. Item 1400 includes six (6) lower retaining saddles, Item 1260. The major curve portion of Item 1260 conforms to the lower surface of horizontal pipe cross member, Item 1120. The combination of threaded fasteners, Item 1259, pipe spacers, Item 1250 and lower retaining saddles, Item 1260, as shown in FIG. 11 affixes Item 1400 to Item 1120 and prevents fore, aft or vertical movement of Item 1400. As previously mentioned in FIG. 9, threaded fastener, Item 1279, in conjunction with pipe pacer, Item 1270, passing through the plate side frame hole, Item 1155, and angle side frame hole, Item 1207, precisely positions Item 1400 with respect to the plate side frame, Item 1150. In this manner the crucial distance between the right and left train rails, Item 40, can be accurately located and maintained preventing out of gauge conditions. The assembly of the right and left formed angle side frames, Item 1200, is accomplished by welding three (3) half pipe cross member and four (4) smaller solid pipe cross members into the receiving slots or holes in the vertical legs of the formed angle side frames, Item 1200. The ends of the half pipe cross braces Item 1230 fit within and are retained by holes, Item 1203. The ends of the smaller solid pipe cross braces Item 1250 fit within and are retained by holes, Item 1209. The inside diameter of the half pipe cross brace, Item 1230, is slightly larger than the outside diameter of horizontal cross members, Item 1120. When completed and assembled on horizontal cross braces, Item 1120, the upper interior surface of Item 1230 rests horizontal and nominally tangent across the upper surface of Item 1120.

Figure 12:
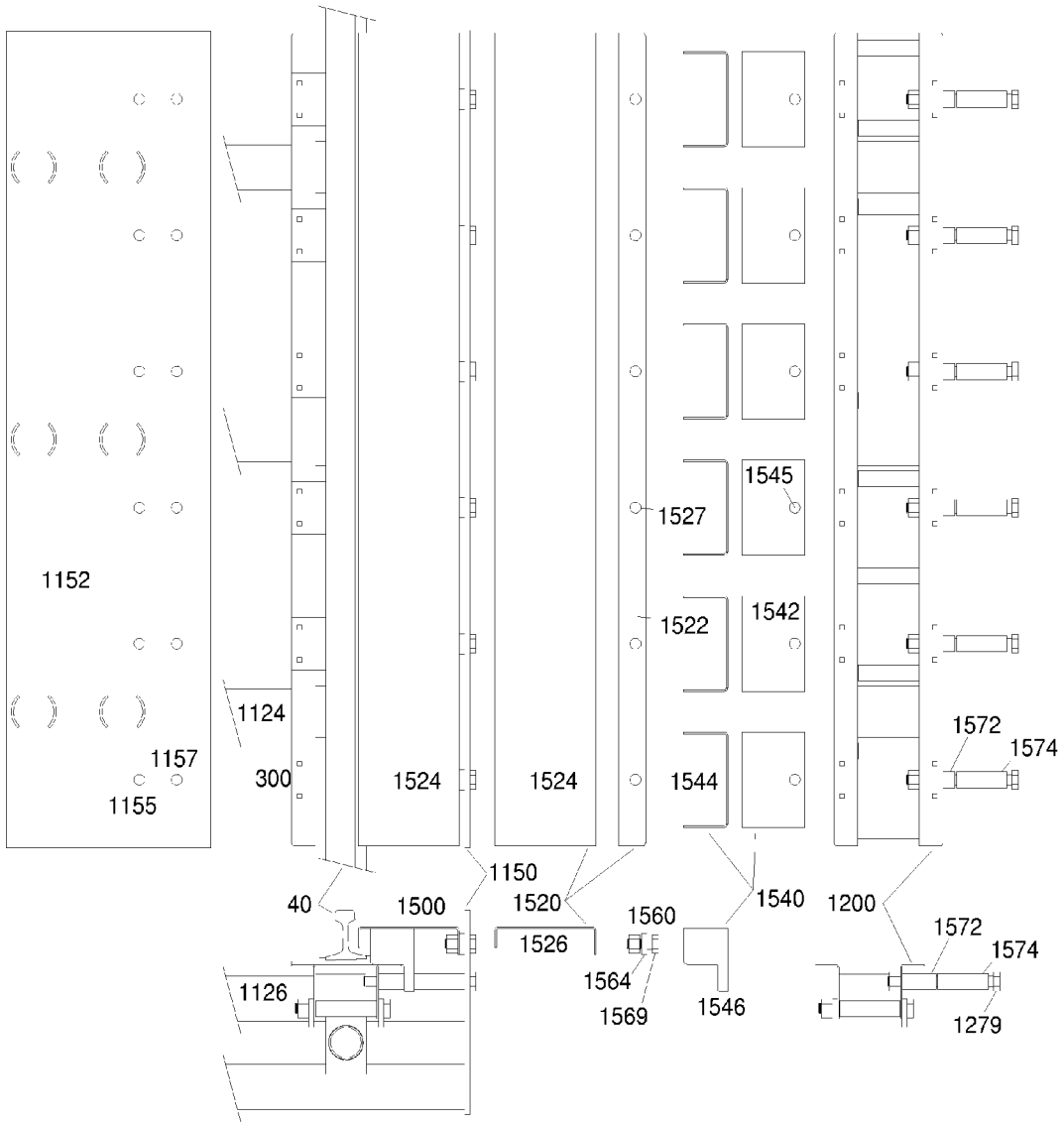
FIG. 12 depicts a configuration similar to that described in FIG. 11 with the addition of a platform located between the train rail and the plate side frame in accordance with an embodiment of the present disclosure.

FIG. 12 depicts a configuration similar to that described in FIG. 11 with the addition of a platform, Item 1500, located between the train rail, Item 40, and the plate side frame, Item 1150 in accordance with an embodiment of the present disclosure. Outrigger platform surfaces between the plate side frames, Item 1150, and the train rails, Item 40, could be used as maintenance walkways or as an additional traction surfaces for dual mode vehicles such as the Blade Runner from Silvertip Design in England. Item 1520 is a formed channel member that is vertically supported by numerous other formed channel members, Item 1540. The top edge of Item 1540 would be welded to the under surface of Item 1520. As depicted in FIG. 12, the top surface, Item 1524, is below the top surface of the trail rail, Item 40, but could as well be at the same level. Item 1520 has various holes, Item 1527 on the formed leg nearest the plate side frame, Item 1150. Threaded fasteners, Item 1560, pass through holes, Item 1157 and Item 1527, to affix Item 1520 to Item 1150. Threaded fasteners, Item 1279, in conjunction with solid pipe spacers, Item 1574 and Item 1572, pass through holes, Item 1155, Item 1545 and Item 1207, to affix Item 1540 to Item 1150 and Item 1200.

Figure 13:
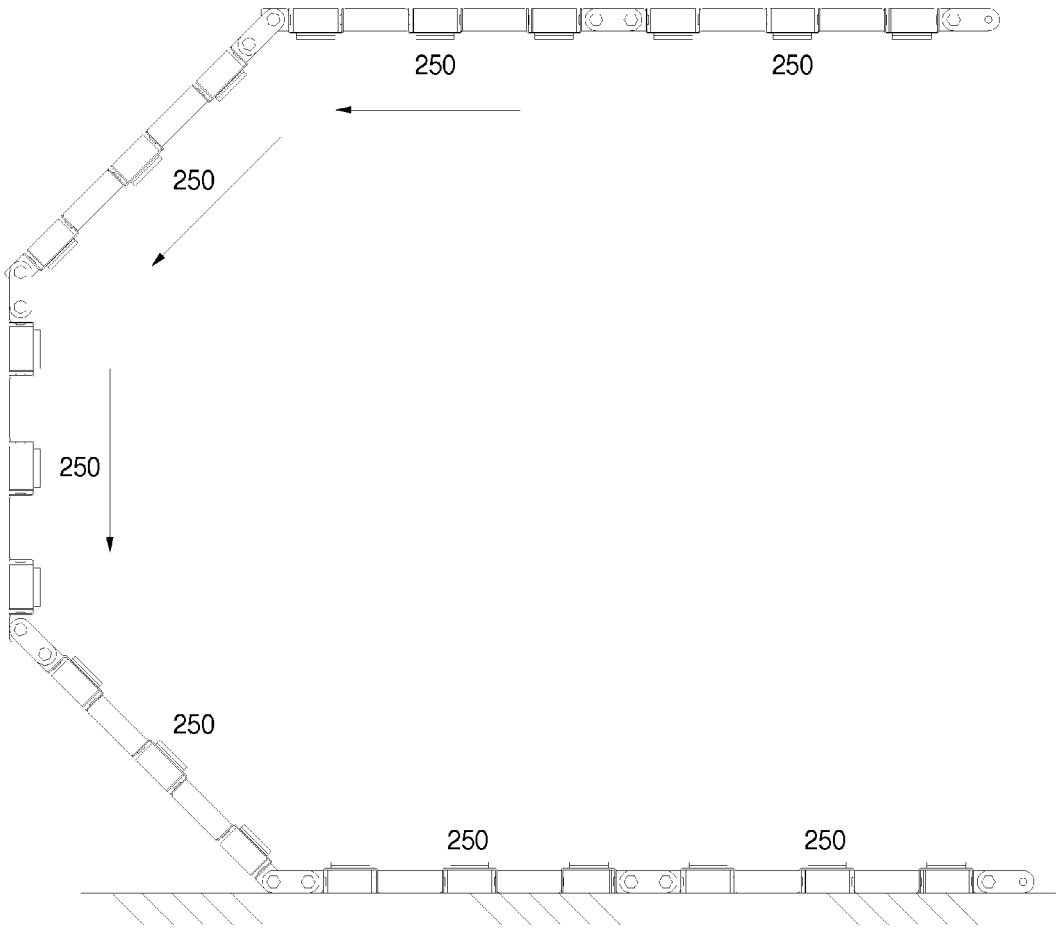
FIG. 13 depicts a snap shot of a continuous loop of connected track sections being fed in upside down in the direction of travel in a continuous, uninterrupted manner in accordance with an embodiment of the present disclosure.

FIG. 13 depicts a snap shot of a continuous loop of connected track sections, Item 250, being fed in upside down in the direction of travel, from behind and above, down and then onto the ballast bed in a continuous, uninterrupted manner in accordance with an embodiment of the present disclosure. These track sections would be linked together by Item 220 link plates, Item 230 bolts and Item 234 threaded nuts. Although not illustrated in FIG. 13, the shape and location of the track sections, Item 250, outline the pathway of a large 'sprocket' being used to lay down this continuous loop of connected track sections, Item 250. This process would be like unto a spool of chain being unrolled while the sprocket moves forward in that process. Continuing in the analogy, the 'chain pitch' would be the length of a single track section, Item 250, which depends upon the spacing between each formed channel cross tie, Item 100, and the number of formed channel cross ties in each section, Item 250. Assuming that the ballast bed has been properly prepared for installation of the cross ties, the machinery for feeding and laying the continuous loop of track sections could ride on top of previously laid 'right side up' track sections, Item 250, as a work pathway. The large 'sprocket' or other means for feeding a continuous flow of connected track sections would be suspended above the ballast bed and in front of the machinery set as it moves forward executing the continuous track laying process. Numerous pre-connected lengths of track sections, Item 250, would be accumulated and staged at the rear of the machinery set for continuous unspooling onto the ballast bed. This method of laying pre-engineered, pre-fabricated, pre-staged lengths of track sections could dramatically increase the rate at which track could be installed. Also, because the formed channel members are all "C-Face Down" or edge down, the track structure would be automatically embedded into the ballast bed as it is installed, eliminating the need for tamping machines to lift the affixed steel rail and solid cross ties, mechanical agitate the rock bed and settle the top surface of the solid cross tie flush with the ballast rock.

In addition to ambient temperature plus solar absorption resulting in the actual rail temperature, heavily laden rail cars can reportedly add as much as 10 F due to vertical flexing, aka cold working or fatiguing, as the wheels pass over the rail. Reducing the unsupported distance between cross ties or supports would significantly reduce the deflection of the rail under load and the heat generated from cold working. Cross tie spacing for wooden ties is typically 20-21" with a tie plate width of about 8 inches. For concrete ties typical spacing is 24-30-36" with a rail seat width is about 6". For monolithic slab track the common spacing is 24-30" with a rail seat width of about 6".

The deflection equation for a freely or simply supported beam with a point load at the center is applicable for this consideration:

$$\text{Deflection}=WL^3/48EI$$

W=weight of the load

L=distance between the supports

E=modulus of elasticity of the material

I=moment of inertia for that particular cross section

For the purposes of illustration assume the track structure employs concrete cross ties at 24" centers and 6" rail seats, which would result in a 18" unsupported distance. The novel improvements identified in this application can result in an unsupported distance of about 5" even though the distance between the inside edges of cross tie plates is a nominal 18". Given that the end supports do not move and all other variables are the same, the difference in deflection for this example would be the ratio 18/5 cubed, which is about 46.7. The 18" unsupported distance for the concrete cross ties would result in a vertical deflection 46.7× greater than the 5" unsupported distance.

Alternatively, if one considers both ends of the rail to be rigidly mounted or fixed the maximum deflection with a point load at the center is:

$$\text{Deflection}=WL^3/192EI$$

This equation indicates less total deflection but the relative deflection between the 18" distance and the 5" distance would still be the ratio of 18/5 cubed.

In addition to the intermediate supports between the rail tie plates being disclosed in this application, novel means and methods for locating and retaining the center point of free floating rail sections are also disclosed. A new design expansion joint that affordably solves the problem of thermally induced rail expansion and contraction was disclosed in a previous application. Use of that new design thermal expansion joint is anticipated in conjunction with the components and track structure systems described herein. Locating and fixing the rail section center point is crucial in order for any expansion joint to function properly in a free floating rail system. The industry term 'rail creep' describes the common tendency of the rail to slowly move in the dominant direction of use. If rail creep is not prevented the capability of the expansion joints to expand and contract within the designed range of adjustment will be closed off and thermally induced stress conditions will return.

Figure 14:
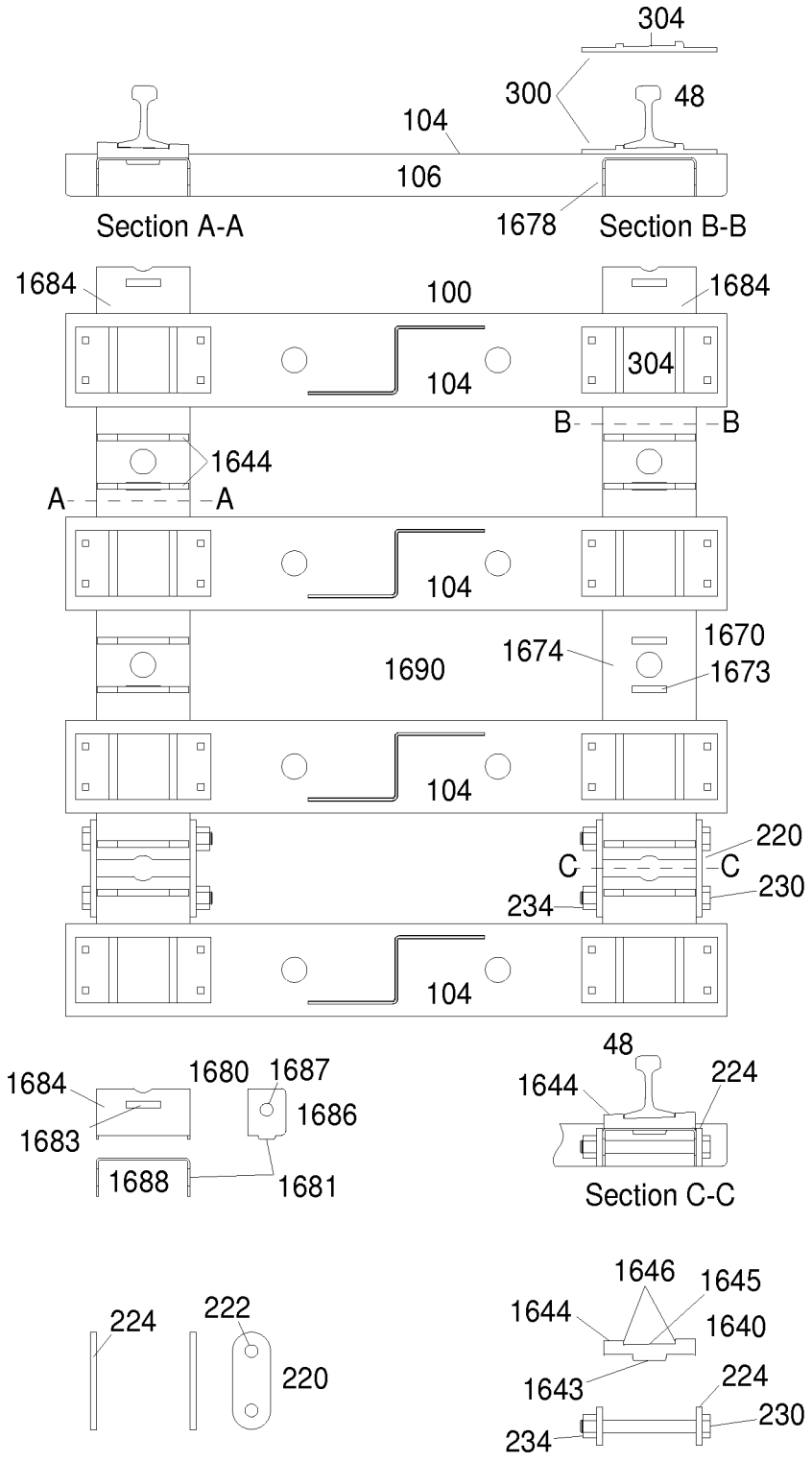
FIG. 14 depicts a single formed steel channel cross tie and formed steel channel connecting link in accordance with an embodiment of the present disclosure.

FIG. 14 depicts a single formed steel channel cross tie and formed steel channel connecting link in accordance with an embodiment of the present disclosure. This design cross tie could be manufactured from other metals, materials and methods and is not limited to steel or the bending of flat sheet to produce the final shape. Item 104 is a top view of the cross tie after forming Item 106 is a side view of the cross tie after forming. Item 300 is the steel rail tie plate that mounts to Item 104. Item 304 is the top surface of Item 300 on which rests the bottom of the steel rail, Item 40. For reasons of clarity in the depiction, Item 40, is only shown in the cross section view, Item 48.

Item 1670 is a formed channel to be used as a connecting link between consecutive Items 100, and is similar to Item 160 as depicted in FIG. 1. When the cross ties, Item 100, and connecting links, Item 1670, are welded together as a unit, they comprise an integrated track section of known length and spacing, Item 1690. Item 1674 is a top view of the formed channel Item 1670. Item 1678 is an end view of the formed channel Item 1670. Item 1673 are rectangular holes in the top surface, Item 1674, of the connecting link Item 1660.

Item 1680 is a formed channel connecting half link similar to Item 200 as depicted in FIG. 2 that is welded to the last steel channel cross ties, Item 100, in an integrated track section, Item 1690. Item 1680 has similar rectangular holes, Item 1683 on its top surface, Item 1684. Items 1687 are opposing holes through Item 1680. These opposing holes are used in conjunction with link plates, Item 220 and conventional threaded fasteners, Item 230 and Item 234, to mechanically connect consecutive welded sections, Item 1690.

Item 1640 is a flat piece of steel plate of known thickness that has been cut in a certain profile, typically by laser or water jet cutter for example. The shape of the bottom tab, Item 1643, in conjunction with the material thickness corresponds to and securely fits within Items 1673 and Items 1683. In the manufacturing process of Item 1690, numerous Items 1640 are placed within corresponding Items 1683 and Items 1673 and fully welded to the upper surfaces of Items 1674 and Items 1684 respectively. As seen in Section A-A and Section B-B the welded in place Items 1640 mimic the profile and elevation of the conventional tie plates, Item 300, that reside on and are affixed to Item 104. In this representation two (2) of the Items 1640 were located in a manner to be approximately equidistant between the nearest edges of two consecutive tie plates, Item 300. As represented in Image 14, interposing two of the Item 1640 intermediate rail supports between the nearest edges of consecutive tie plates, Item 300, reduces the unsupported distance of the steel rail by a nominal factor of 3. The number of Items 1640 located between the consecutive tie plates could be more or less than two (2) and the intended function of providing intermediate vertical support to the rail between the tie plates would be accomplished.

When the rail, Item 40, resides within Item 1640, the bottom of Item 40 rests on Item 1645. The depth of the recess into Item 1640 is sufficient so that the upper edges of the rail base are beneath the vertical height of Items 1646. This captured relationship between the edges of the rail bases and Items 1645 further constrains the rail from lateral flexing and resists changes in the gauge or distance between the rails.

Figure 15:
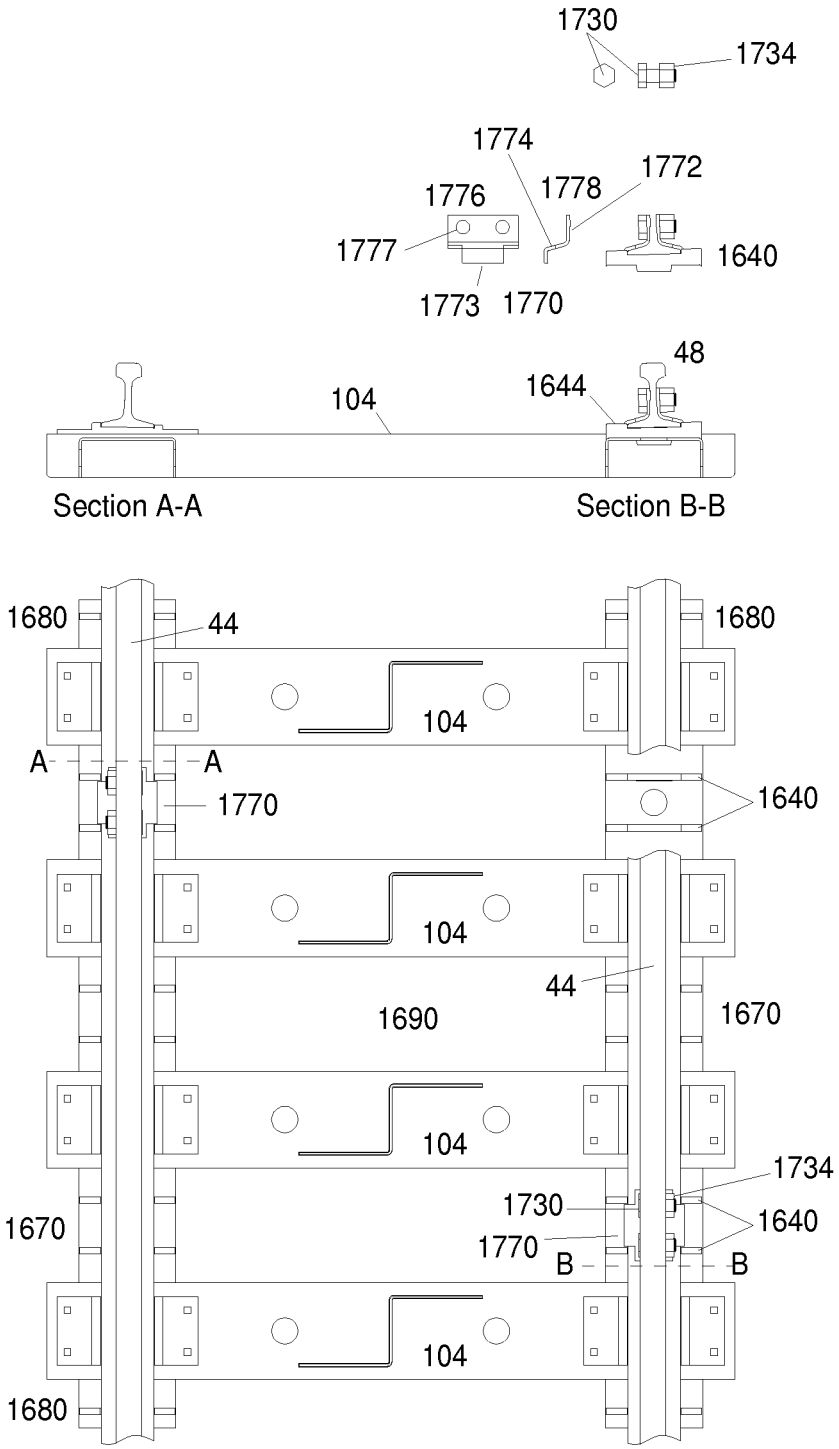
FIG. 15 depicts a single welded unit comprising various affixed items in accordance with an embodiment of the present disclosure.

FIG. 15 depicts a single welded unit comprising various affixed items in accordance with an embodiment of the present disclosure. The depiction includes Item 1690 comprised of four (4) Item 100, six (6) Item 1670, four (4) Item 1680, sixteen (16) Item 1640 and eight (8) Item 300 affixed to the tops of the Items 100. Additionally, there are two (2) pairs of Item 1770, which are rail center point anchors to be mounted to the rail after it has been installed on the track structure system in the field. These center point anchors would work in conjunction with devices like the Pandrol Zero Longitudinal Restraint in the tie plates and seamless, overlapping expansion joints at the rail ends to result in a free floating rail system that expands and contracts from the fixed center point without generating thermally induced stresses and without concern for rail creep closing off the range of adjustment in the expansion joints.

In this depiction the interior surface, Item 1772, conforms to the exterior web surface of the rail, Item 40. When the expansion joint relationship and dimensions have been set between consecutive rail sections and the rail center located, holes are drilled through the web of the rail, Item 40, at or near the center point of that rail section. The size, spacing and specific location of the holes are such that a pair of Item 1770 can be affixed flush to the exterior web of the rail, Item 40, with conventional threaded fasteners, Items 1730 and Items 1734. Correspondingly, when the pair of Item 1770 is affixed with the threaded fasteners, the lower tabs Item 1773 will reside between a pair of Items 1640 located on an Item 1670. This execution would mechanically position that center point location relative to track structure and allow for thermal expansion and contraction from that position. Other means and methods of locating and affixing the center point of a rail section are not depicted in this application, could be utilized and are anticipated by this disclosure.

Figure 16:
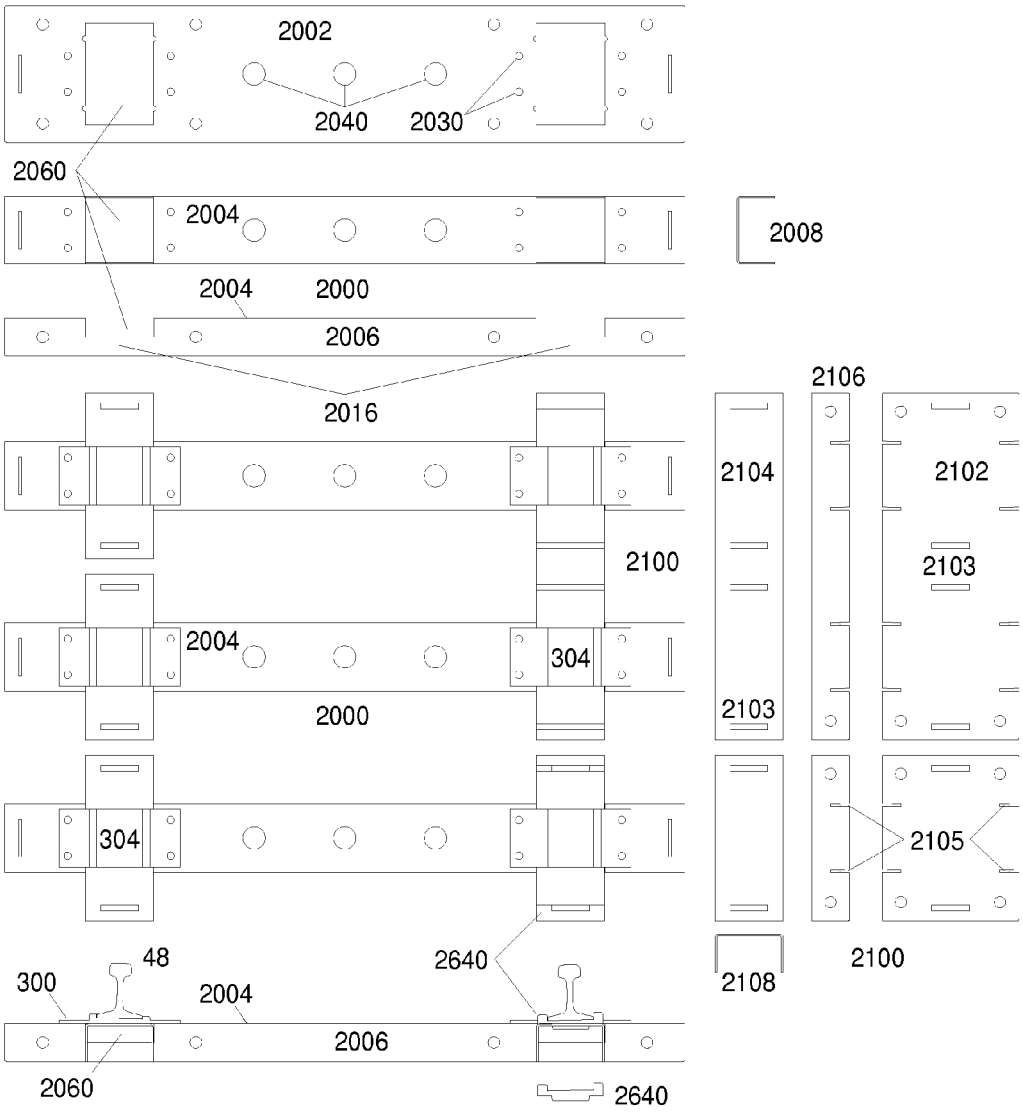
FIG. 16 depicts a different configuration and construction of the completed formed channel cross ties in accordance with an embodiment of the present disclosure.

FIG. 16 depicts a different configuration and construction of the completed formed channel cross tie, Item 2000 in accordance with an embodiment of the present disclosure. As described earlier, the completed formed channel cross tie can be utilized as a separate unit or as an integrated assembly of more than one cross tie. In this representation Item 2000 employs an interlocking and overlapping formed channel end bracket, Item 2100. Item 2100 can be configured to engage a single Item 2000 or more than one Item 2000.

Item 2004 is a top view of the formed channel steel cross tie. Item 2002 is a flat sheet representation of Item 2000 before forming into the channel cross section. Item 2008 is an end view of the formed steel cross tie after forming into the channel cross section. Item 2006 is a side view of the formed steel cross tie. Item 2040 are circular holes arranged along the top surface of Item 2000 after forming. Item 2030 are pairs of holes arranged along the top surface of Item 2000 used for locating and mounting the tie plate, Item 300, and steel rail to Item 2000. Item 304 is a top view of the rail tie plate, Item 300. Item 2060 is a nominal rectangular shaped hole between opposing pairs of Item 2030 and seen in Item 2002, Item 2004 and Item 2006. Item 2060 acts as a receptacle for the formed channel end bracket, Item 2100. When Item 2100 is fully engaged with Item 2000, the top surface of Item 2000 and Item 2100 are essentially flush allowing for flat installation of rail tie plate, Item 300, above and across both Item 2000 and Item 2100.

Item 2104 is the top view of the formed steel end bracket. Item 2102 is a flat sheet representation of Item 2100 before forming into the channel cross section. Item 2108 is an end view of the end bracket after forming into the channel cross section. Item 2106 is a side view of the formed steel end bracket. Item 2103 are rectangular holes arranged along the top surface, Item 2104, for receiving intermediate rail supports, Item 2640. Item 2640 serves the same function of Item 1640 seen in FIG. 14 but is dimensional different to accommodate the flush surface relationship when Item 2000, Item 2100 and Item 300 are assembled. Item 2105 are slits cut into the legs or sides of Item 2100. The location, spacing and width of Items 2105 allow for full insertion of Item 2100 down and into Item 2060 of Item 2000. When fully inserted, Items 2105 engage and capture the lower portion, Item 2016, of Item 2000. This interlocking and interleaving relationship between Item 2000 and Item 2100 provides precise arrangement between the two. After assembly, Item 2000, Item 2100 and Item 300 would be welded together forming an integral, robust, lightweight, precision cross tie system.

Figure 17:
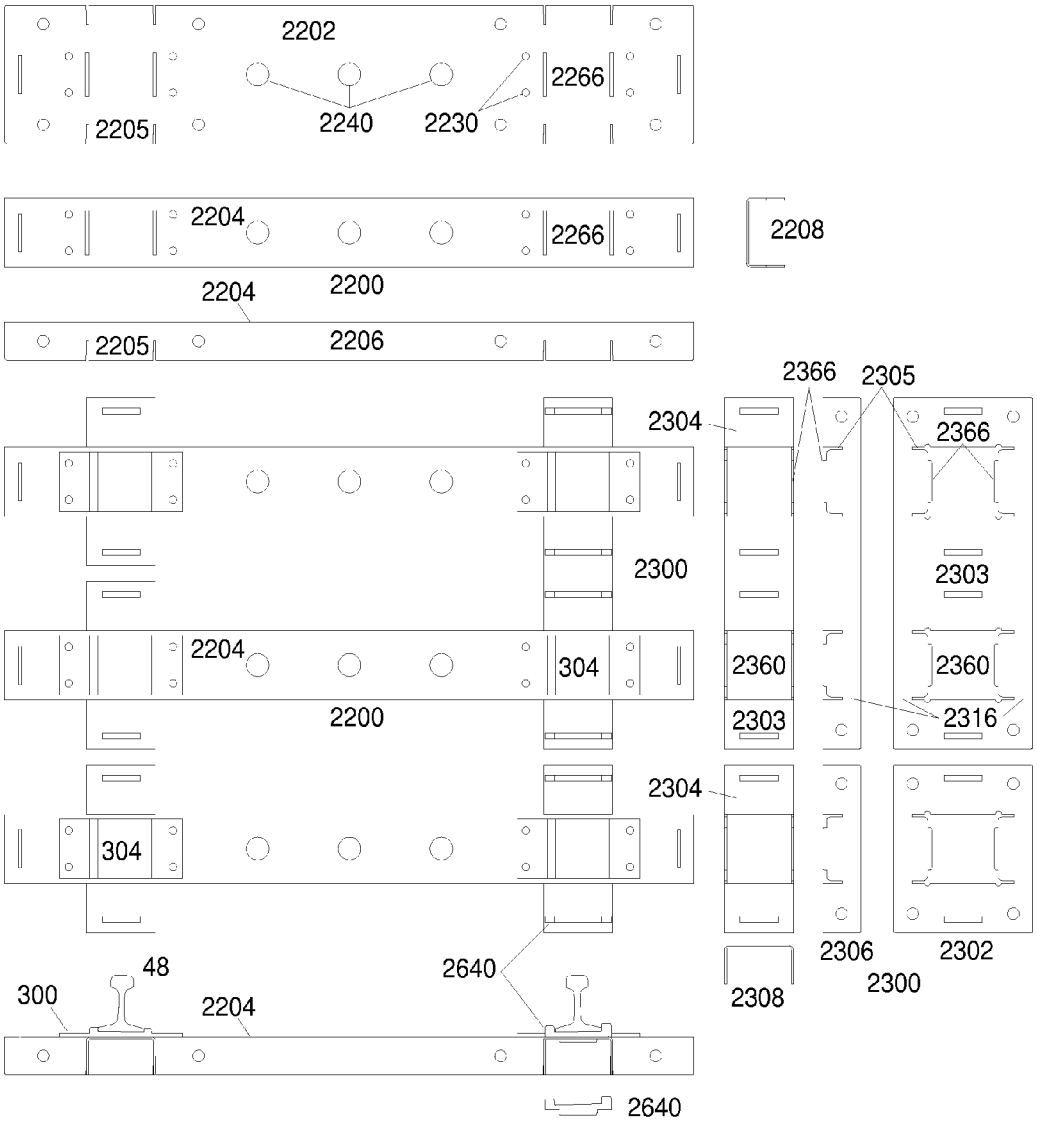
FIG. 17 depicts another configuration and construction of the completed formed channel cross ties in accordance with an embodiment of the present disclosure.

FIG. 17 depicts another configuration and construction of the completed formed channel cross tie, Item 2200 in accordance with an embodiment of the present disclosure. As described earlier, the completed formed channel cross tie can be utilized as a separate unit or as an integrated assembly of more than one cross tie. In this representation Item 2200 employs an interlocking and overlapping formed channel end bracket, Item 2300. Item 2300 can be configured to engage a single Item 2200 or more than one Item 2200.

Item 2204 is a top view of the formed channel steel cross tie. Item 2202 is a flat sheet representation of Item 2200 before forming into the channel cross section. Item 2208 is an end view of the formed steel cross tie after forming into the channel cross section. Item 2206 is a side view of the formed steel cross tie. Item 2240 are circular holes arranged along the top surface of Item 2200 after forming. Item 2230 are pairs of holes arranged along the top surface of Item 2200 used for locating and mounting the tie plate, Item 300, and steel rail to Item 2200. Item 304 is a top view of the rail tie plate, Item 300. Items 2266 are rectangular shaped slits between opposing pairs of Item 2230 and seen in Item 2202 and Item 2204. Items 2266 act as receptacles for tabs, Item 2366, in the formed channel end bracket, Item 2300. When Item 2200 is fully engaged with Item 2300, the top surface of Item 2000 and Item 2100 are essentially flush allowing for flat installation of rail tie plate, Item 300, above and across both Item 2000 and Item 2100. When Item 2200 is fully engaged with Item 2300, Items 2366 reside within Items 2266 with the upper edge of Items 2366 not above the top surface of Item 2200 and within the material thickness of Item 2200.

Item 2205 are slits cut into the legs or sides of Item 2200. The location, spacing and width of Items 2205 allow for full insertion with Item 2300 down and into Items 2305 of Item 2300. When fully inserted, Items 2205 engage and capture the lower portion, Item 2316, of Item 2300.

Item 2304 is the top view of the formed steel end bracket. Item 2302 is a flat sheet representation of Item 2300 before forming into the channel cross section. Item 2308 is an end view of the end bracket after forming into the channel cross section. Item 2306 is a side view of the formed steel end bracket. Item 2303 are rectangular holes arranged along the top surface, Item 2304, for receiving intermediate rail supports, Item 2640. Item 2640 serves the same function of Item 1640 seen in FIG. 14 but is dimensional different to accommodate the flush surface relationship when Item 2200, Item 2300 and Item 300 are assembled. Item 2305 are slits cut into the midsection of Item 2300. The location, spacing and width of Items 2305 allow for full insertion of Item 2200 down and into the hole, Item 2360, of Item 2300. When fully inserted, Items 2205 engage and capture the lower portion, Item 2316, of Item 2300. This interlocking and interleaving relationship between Item 2200 and Item 2300 provides precise arrangement between the two. After assembly, Item 2200, Item 2300 and Item 300 would be welded together forming an integral, robust, lightweight, precision cross tie system.

Figure 18:
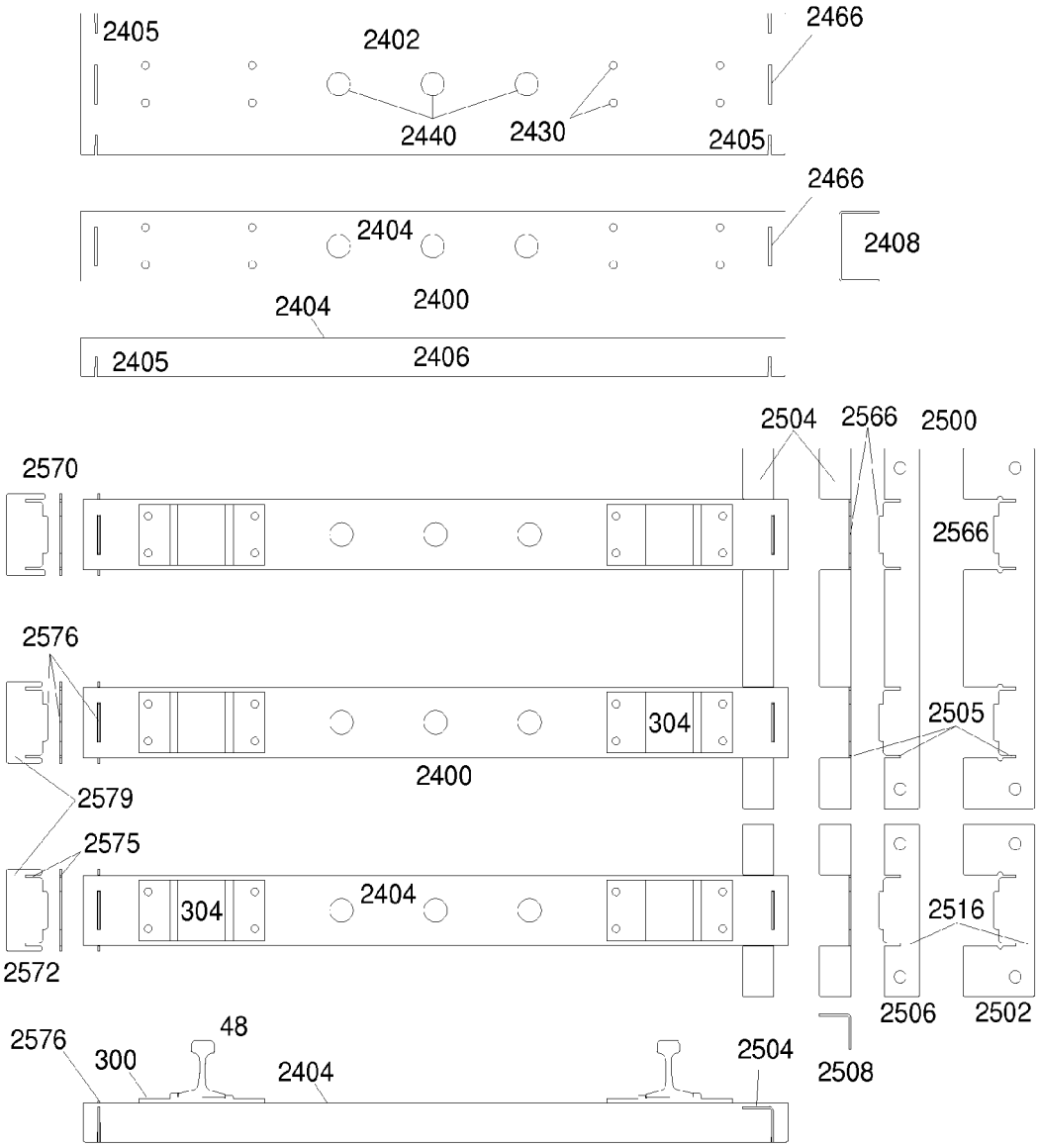
FIG. 18 depicts a further configuration and construction of the completed formed channel cross tie in accordance with an embodiment of the present disclosure.

FIG. 18 depicts a further configuration and construction of the completed formed channel cross tie, Item 2400 in accordance with an embodiment of the present disclosure. As described earlier, the completed formed channel cross tie can be utilized as a separate unit or as an integrated assembly of more than one cross tie. In this representation Item 2400 employs an interlocking and overlapping formed angle end bracket, Item 2500 or an interlocking and overlapping flat end plate, Item 2570. Item 2500 and Item 2570 can be configured to engage a single Item 2400 or more than one Item 2400.

Item 2404 is a top view of the formed channel steel cross tie. Item 2402 is a flat sheet representation of Item 2400 before forming into the channel cross section. Item 2408 is an end view of the formed steel cross tie after forming into the channel cross section. Item 2406 is a side view of the formed steel cross tie. Item 2440 are circular holes arranged along the top surface of Item 2400 after forming. Item 2430 are pairs of holes arranged along the top surface of Item 2400 used for locating and mounting the tie plate, Item 300, and steel rail, Item 48, to Item 2400. Item 304 is a top view of the rail tie plate, Item 300. Items 2466 are rectangular shaped slits outside of opposing pairs of Item 2430 and seen in Item 2402 and Item 2404. Items 2466 act as receptacles for tabs, Item 2566, in the formed angle end bracket, Item 2500, and Item 2576 in the flat end plate, Item 2570. When Item 2400 is fully engaged with Item 2500 or Item 2576 the top surface of Item 2566 or Item 2576 is slightly above the top surface of Item 2400 to facilitate welding with Item 2400.

Item 2405 are slits cut into the legs or sides of Item 2400. The location, spacing and width of Items 2405 allow for full insertion with Item 2500 down and into Item 2505 of Item 2530 or Item 2575 of Item 2570. When fully inserted, Items 2405 engage and capture the lower portion, Item 2516, of Item 2500 or Item 2579 of Item 2570.

Item 2504 is the top view of the formed steel end bracket. Item 2502 is a flat sheet representation of Item 2500 before forming into the angle cross section. Item 2508 is an end view of the end bracket after forming into the angle cross section. Item 2506 is a side view of the formed steel end bracket. Item 2505 are slits cut into the midsection of Item 2500. The location, spacing and width of Items 2505 allow for full insertion of Item 2400 down and into Item 2500.

When fully inserted, Items 2405 engage and capture the lower portion, Item 2516, of Item 2500. This interlocking and interleaving relationship between Item 2400 and Item 2500 provides precise arrangement between the two. After assembly, Item 2400 and Item 2500 would be welded together forming an integral, robust, lightweight, precision cross tie system.

When fully inserted, Items 2405 engage and capture the lower portion, Item 2579, of Item 2570. This interlocking and interleaving relationship between Item 2400 and Item 2570 provides precise arrangement between the two. After assembly, Item 2400 and Item 2570 would be welded together forming an integral, robust, lightweight, precision cross tie system.

Figure 19:
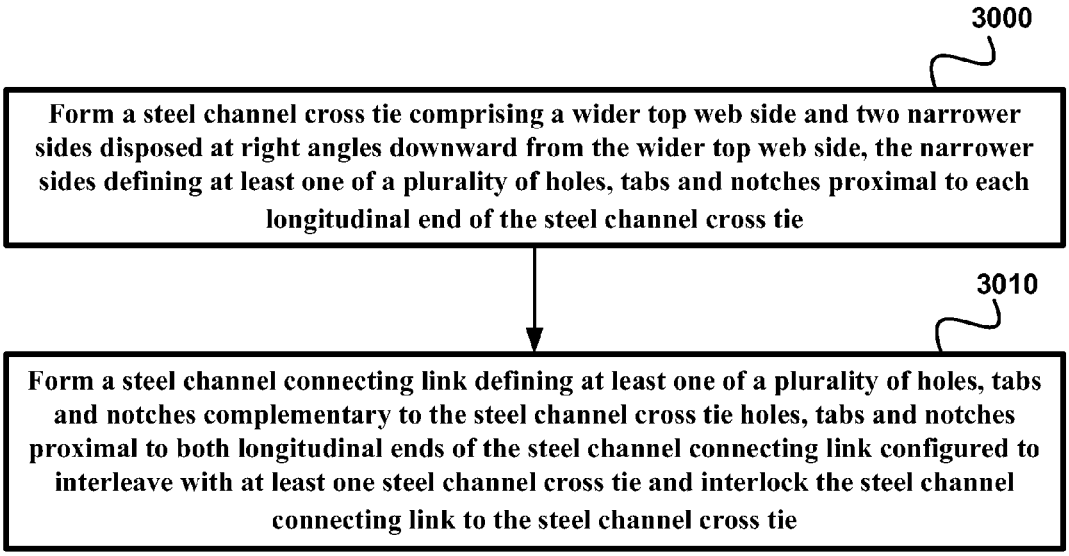
FIG. 19 is a flow chart of a method for making a train rail track structure system in accordance with an embodiment of the present disclosure.

FIG. 19 is a flow chart of a method for making a train rail track structure system in accordance with an embodiment of the present disclosure. The method includes forming 3000 a steel channel cross tie comprising a wider top web side and two narrower sides disposed at right angles downward from the wider top web side, the narrower sides defining at least one of a plurality of holes, tabs and notches proximal to each longitudinal end of the steel channel cross tie. The method also includes forming 3010 a steel channel connecting link defining at least one of a plurality of holes, tabs and notches complementary to the steel channel cross tie holes, tabs and notches proximal to both longitudinal ends of the steel channel connecting link configured to interleave with at least one steel channel cross tie and interlock the steel channel connecting link to the steel channel cross tie.

Figure 20:
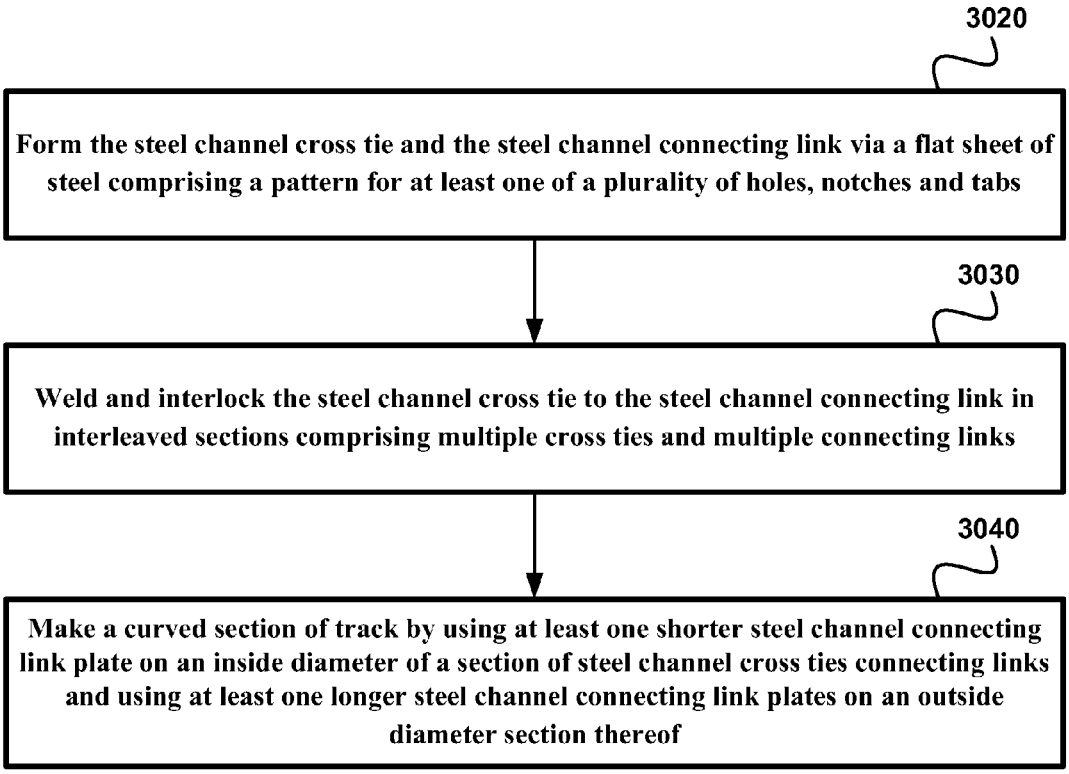
FIG. 20 is another flow chart of a method for making a train rail track structure system in accordance with an embodiment of the present disclosure.

FIG. 20 is another flow chart of a method for making a train rail track structure system in accordance with an embodiment of the present disclosure. The embodied method includes forming 3020 the steel channel cross tie and the steel channel connecting link from a flat sheet of steel comprising a pattern for at least one of a plurality of holes, notches and tabs. The holes, notches and tabs may be formed by stamping, drilling, cutting and other mechanisms and method known to those learned in the art. Embodiments of making the disclosed train rail track structure may additionally include welding 3030 and interlocking the steel channel cross tie to the steel channel connecting link in interleaved sections comprising multiple cross ties and multiple connecting links. A further embodiment of the method of making the train rail track structure system includes making 3040 a curved section of track by using at least one shorter steel channel connecting link on an inside diameter of a section of steel channel cross ties and using at least one longer steel channel connecting link on an outside diameter section thereof.

A curved section of track may also be made in accordance with an embodiment of the present disclosure by using a plurality of connecting link plates with multiple slots therein. The slots allow for a lateral flexing of connected steel channel cross ties such that a first end section of the connected steel channel cross ties generates a smaller inside diameter of the train rail structure and an opposing end section of the steel channel cross ties generates a larger outside diameter of the train rail track structure thereof.

Although the components herein are shown and described in a particular order, the order thereof may be altered so that certain advantages or characteristics may be optimized. In another embodiment, instructions or sub-operations of distinct steps may be implemented in an intermittent and/or alternating manner.

Notwithstanding specific embodiments of the invention have been described and illustrated, the invention is not to be limited to the specific forms or arrangements of parts so described and illustrated. The scope of the invention is to be defined by the claims and their equivalents.

What is claimed is:

1. A train rail track structure system, comprising:

a steel channel cross tie comprising a wider top web side and two narrower sides disposed at right angles downward from the wider top web side, the narrower sides defining a first plurality of notches proximal to each longitudinal end of the steel channel cross tie; and a steel channel connecting link defining a first plurality of tabs complementary to the steel channel cross tie notches proximal to both longitudinal ends of the steel channel connecting link configured to interlock the steel channel connecting link to the steel channel cross tie.

2. The train rail track structure system of claim 1, further comprising a first plurality of holes in the top web side, the first plurality of holes configured to pass a fixative or solidifying mixture into a ballast bed there beneath and further affix the steel channel cross tie into the ballast bed.

3. The train rail track structure system of claim 1, further comprising a protrusion with a plurality of perpendicular faces extending from an underside of the top web side, the protrusion with perpendicular faces being nominally perpendicular to a longitudinal major axis of the cross tie, the protrusion having a height nominally equal to or greater than a height of the narrower sides of the steel channel cross tie to anchor the steel channel cross tie into a ballast bed there beneath.

4. The train rail track structure system of claim 1, further comprising a rail center point anchor configured to anchor a section of train rail to a specific location within the rail track structure and allow thermal expansion of the train rail section from either side of the anchor and inhibit rail creep from closing off an expansion joint expansion.

5. The train rail track structure of claim 4, further comprising a clip configured to conform to an exterior web surface of the rail and fasten thereto and provide the center point anchor to the specific location of the train rail structure.

6. The train rail track structure system of claim 1, further comprising a steel channel connecting link half piece comprising one a second plurality of tabs and a second plurality of notches proximal to one longitudinal end of the steel channel connecting link and another longitudinal end configured to fasten to another steel channel connecting link half piece.

7. The train rail track structure system of claim 1, wherein the steel channel connecting link defines at least one hole in a top surface thereof to pass a fixative or solidifying mixture into a ballast bed there beneath.

8. The train rail track structure system of claim 1, further comprising at least one intermediate rail support member configured to engage and provide vertical and horizontal rail support between a first and a second steel channel cross tie.

9. The train rail track structure system of claim 1, further comprising an end plate configured for the longitudinal ends of the steel channel cross tie, the end plate including at least one of a third plurality of notches and a third plurality of tabs configured to engage with the cross tie, the end plate configured to contain a ballast within the steel channel cross tie.

10. The train rail track structure system of claim 1, further comprising a formed steel end bracket configured to engage with the steel channel cross tie, the formed steel end bracket comprising a top web side and one narrower side, the end bracket configured to contain a ballast within a nominal ballast bed structure.

11. The train rail track structure of claim 1, wherein the steel channel cross tie and the steel channel connecting link are formed from a stamped flat sheet of steel comprising the two narrower sides disposed at a right angle to the wider top web side.

12. The train rail track structure of claim 1, further comprising an insulating and isolating pad mounted between a steel rail tie plate and a top surface of the top web of the steel channel cross tie, the insulating and isolating plate comprising compressible plastic and rubber material configured to absorb a weight of a passing train and attenuate noise and electrically isolate the steel rail.

13. The train rail track structure of claim 1, wherein the steel channel cross tie and the steel channel connecting link together are configured to retain and trap a rock ballast and a fixative or solidifying mixture and therefore anchor the rail track structure to and within the rock ballast bed and create a composite structure.

14. A train rail track structure system, comprising:

a c-face down steel channel cross tie defining a plurality of holes in a top wider web surface thereof and a protrusion with a plurality of perpendicular faces extending from an underside of the top surface, the holes configured to pass a fixative and solidifying mixture into a ballast bed there beneath and the protrusion with perpendicular faces configured to anchor the steel channel cross tie in the fixative and solidifying mixture and the ballast bed; and a c-face down steel channel connecting link defining a receptacle for at least one intermediate rail support member in a top wider web surface thereof and also defining one of a plurality of tabs and notches proximal to both longitudinal ends of the steel channel connecting link configured to interlock the steel channel connecting link to the steel channel cross tie.

* * * * *